US008257153B2

(12) United States Patent
Fukuda et al.

(10) Patent No.: US 8,257,153 B2
(45) Date of Patent: Sep. 4, 2012

(54) POLISHING PAD AND A METHOD FOR MANUFACTURING THE SAME

(75) Inventors: Takeshi Fukuda, Osaka (JP); Junji Hirose, Osaka (JP); Kenji Nakamura, Osaka (JP); Masato Doura, Osaka (JP); Akinori Sato, Osaka (JP)

(73) Assignee: Toyo Tire & Rubber Co., Ltd., Osaka-shi (JP)

( * ) Notice: Subject to any disclaimer, the term of this patent is extended or adjusted under 35 U.S.C. 154(b) by 392 days.

(21) Appl. No.: 12/519,339

(22) PCT Filed: Nov. 27, 2007

(86) PCT No.: PCT/JP2007/072852

§ 371 (c)(1), (2), (4) Date: Jun. 15, 2009

(87) PCT Pub. No.: WO2008/087797

PCT Pub. Date: Jul. 24, 2008

(65) Prior Publication Data

US 2010/0029185 A1 Feb. 4, 2010

(30) Foreign Application Priority Data

Jan. 15, 2007 (JP) ..... 2007-006218
Jan. 15, 2007 (JP) ..... 2007-006224
Jan. 15, 2007 (JP) ..... 2007-006229
Jan. 15, 2007 (JP) ..... 2007-006232

(51) Int. Cl.
*B24D 11/00* (2006.01)

(52) U.S. Cl. ..... 451/527; 451/533

(58) Field of Classification Search ..... 451/526, 451/527, 528, 530, 533
See application file for complete search history.

(56) References Cited

U.S. PATENT DOCUMENTS 3,049,463 A 8/1962 Kallander et al.
3,284,274 A 11/1966 Hulslander et al.
4,216,177 A 8/1980 Otto
5,409,770 A 4/1995 Netsu et al.
5,607,982 A 3/1997 Heyman et al.
6,099,954 A 8/2000 Urbanavage et al.
6,107,355 A 8/2000 Horn et al.

(Continued)

FOREIGN PATENT DOCUMENTS

CN 1407606 4/2003

(Continued)

OTHER PUBLICATIONS

International Search Report, mailed on Sep. 26, 2006, directed to International Patent Application No. PCT/JP2006/313597; 5 pages.

(Continued)

*Primary Examiner* — Dung Van Nguyen
(74) *Attorney, Agent, or Firm* — Morrison & Foerster LLP

(57) ABSTRACT

A polishing pad of excellent durability and adhesion between the polishing layer and the base material layer includes a polishing layer arranged on a base material layer, wherein the polishing layer includes a thermosetting polyurethane foam having roughly spherical interconnected cells having an average cell diameter of 20 to 300 μm The polyurethane foam includes an isocyanate component and an active hydrogen-containing compound as starting material components, and the active hydrogen-containing compound includes 30 to 85% by weight of a high-molecular-weight polyol having 2 to 4 functional groups and a hydroxyl value of 20 to 100 mg KOH/g.

12 Claims, 2 Drawing Sheets

U.S. PATENT DOCUMENTS

| | | | |
|---|---|---|---|
| 6,420,448 | B1 | 7/2002 | Hnatow et al. |
| 6,803,495 | B2 | 10/2004 | Simpson |
| 7,261,625 | B2 | 8/2007 | Hishiki |
| 7,291,063 | B2 | 11/2007 | Swisher et al. |
| 7,378,454 | B2 | 5/2008 | Masui et al. |
| 7,762,870 | B2 | 7/2010 | Ono et al. |
| 7,927,452 | B2 | 4/2011 | Hirose et al. |
| 2002/0183409 | A1 | 12/2002 | Seyanagi et al. |
| 2003/0109209 | A1 | 6/2003 | Hishiki |
| 2004/0024719 | A1 | 2/2004 | Adar et al. |
| 2004/0142641 | A1 | 7/2004 | Ohno et al. |
| 2004/0166790 | A1 | 8/2004 | Balijepalli et al. |
| 2005/0064709 | A1 | 3/2005 | Shimomura et al. |
| 2005/0112354 | A1 | 5/2005 | Kume et al. |
| 2005/0222288 | A1 | 10/2005 | Seyanagi et al. |
| 2006/0022368 | A1 | 2/2006 | Lee et al. |
| 2006/0280929 | A1 | 12/2006 | Shimomura et al. |
| 2006/0280930 | A1 | 12/2006 | Shimomura et al. |
| 2009/0011221 | A1 | 1/2009 | Kawaguchi et al. |
| 2009/0093202 | A1 | 4/2009 | Fukuda et al. |
| 2010/0003896 | A1 | 1/2010 | Nakai et al. |
| 2010/0009611 | A1 | 1/2010 | Fukuda et al. |
| 2010/0029182 | A1 | 2/2010 | Fukuda et al. |
| 2010/0317263 | A1 | 12/2010 | Hirose et al. |
| 2011/0151240 | A1 | 6/2011 | Hirose et al. |

FOREIGN PATENT DOCUMENTS

| | | |
|---|---|---|
| CN | 1586002 | 2/2005 |
| CN | 1602321 | 3/2005 |
| CN | 1625575 | 6/2005 |
| JP | 60-042431 | 3/1985 |
| JP | 2-100321 | 4/1990 |
| JP | 4-159084 | 6/1992 |
| JP | 4-202215 | 7/1992 |
| JP | 5-329852 | 12/1993 |
| JP | 06-023664 | 2/1994 |
| JP | 6-262633 | 9/1994 |
| JP | 11-207758 | 8/1999 |
| JP | 2000-246620 | 9/2000 |
| JP | 2001-62703 | 3/2001 |
| JP | 2002-060452 | 2/2002 |
| JP | 2002-217149 | 8/2002 |
| JP | 2002-226608 | 8/2002 |
| JP | 2002-264912 | 9/2002 |
| JP | 2002-307293 | 10/2002 |
| JP | 2002-355754 | 12/2002 |
| JP | 2003-37089 | 2/2003 |
| JP | 2003-100681 | 4/2003 |
| JP | 2003-209079 | 7/2003 |
| JP | 2003-304951 | 10/2003 |
| JP | 3490431 | 11/2003 |
| JP | 2004-002788 | 1/2004 |
| JP | 2004-87647 | 3/2004 |
| JP | 2004-119657 | 4/2004 |
| JP | 2004-169038 | 6/2004 |
| JP | 2004-188716 | 7/2004 |
| JP | 2004-291155 | 10/2004 |
| JP | 2004-335713 | 11/2004 |
| JP | 2004-337992 | 12/2004 |
| JP | 2005-34971 | 2/2005 |
| JP | 2005-68175 | 3/2005 |
| JP | 2005-131720 | 5/2005 |
| JP | 2005-153053 | 6/2005 |
| JP | 2005-330621 | 12/2005 |
| JP | 2006-502300 | 1/2006 |
| JP | 2006-35367 | 2/2006 |
| JP | 2006-75914 | 3/2006 |
| JP | 2006-222349 | 8/2006 |
| JP | 2006-519115 | 8/2006 |
| JP | 2006-231429 | 9/2006 |
| JP | 2006-255828 | 9/2006 |
| JP | 2006-265303 | 10/2006 |
| JP | 2006-297515 | 11/2006 |
| JP | 2006-334745 | 12/2006 |
| JP | 2006-339570 | 12/2006 |
| JP | 2006-342191 | 12/2006 |
| JP | 2007-283712 | 1/2007 |
| JP | 2007-112032 | 5/2007 |
| JP | 2007-307700 | 11/2007 |
| JP | 2008-31034 | 2/2008 |
| JP | 2008-156519 | 7/2008 |
| TW | I222390 | 10/2004 |
| WO | WO-01/96434 | 12/2001 |
| WO | WO-2005/055693 | 6/2005 |
| WO | WO-2007/010766 | 1/2007 |
| WO | WO-2007/123168 | 11/2007 |
| WO | WO-2008/026451 | 3/2008 |

OTHER PUBLICATIONS

International Search Report mailed Jun. 2, 2009, directed to International Patent Application No. PCT/JP2009/053481; 3 pages.
Chinese Office Action mailed Dec. 18, 2009, directed to Chinese Patent Application No. 2006800259433; 11 pages.
Japanese Notification of Reasons for Refusal mailed Jul. 22, 2010, directed at foreign application No. JP-2008-063034; 6 pages.
Japanese Notification of Reasons for Refusal mailed Apr. 8, 2011 directed towards Japanese Patent Application No. 2006-072873; 6 pages.
Japanese Notification of Reasons for Refusal mailed Apr. 8, 2011 directed towards Japanese Patent Application No. 2006-072945; 6 pages.
Japanese Notification of Reasons for Refusal mailed Apr. 8, 2011 directed towards Japanese Patent Application No. 2006-072957; 6 pages.
Hirose, U.S. Office Action mailed May 4, 2010, directed to related U.S. Appl. No. 11/995,311; 9 pages.
Hirose et al., U.S. Office Action mailed Sep. 26, 2011, directed to U.S. Appl. No. 13/038,849; 11 pages.
International Search Report mailed on Mar. 11, 2008 directed at counterpart application No. PCT/JP2007/072852;4 pages.
Taiwanese Office Action mailed Sep. 7, 2011, directed to Taiwanese Application No. 096146036; 14 pages.
International Search Report mailed Jun. 5, 2007, directed to International Application No. PCT/JP2007/058757; 1 page.
Japanese Office Action mailed Jan. 22, 2008, directed to Japanese Application No. 2007-227773; 3 pages.
Chinese Office Action mailed Apr. 22, 2010, directed to Chinese Application No. 200780033122.9; 13 pages.
Taiwanese Office Action dated Oct. 28, 2010, directed to Taiwanese Application No. 096114786; 6 pages.
Korean Notice to Submit a Response dated Mar. 30, 2011, directed to Korean Application No. 10-2009-7004682; 6 pages.
Chinese Decision on Rejection dated Apr. 15, 2011, directed to Chinese Application No. 200780033122.9; 16 pages.
Malaysian Substantive Examination Adverse Report dated Dec. 15, 2011, directed to Malaysian Application No. PI 20080065; 3 pages.
Fukuda et al., U.S. Office Action mailed Nov. 8, 2011, directed to U.S. Appl. No. 12/439,992; 11 pages.
Fukuda, T. et al., U.S. Office Action mailed Jun. 2, 2011, directed to U.S. Appl. No. 12/440,003; 7 pages.
Japanese Office Action mailed Jan. 22, 2008, directed to Japanese Application No. 2007-112032; 3 pages.
International Search Report mailed Jun. 5, 2007, directed to International Application No. PCT/JP2007/058758; 1 page.
Taiwanese Office Action dated Aug. 20, 2009, directed to Taiwanese Application No. 096114785; 9 pages.
Korean Office Action dated Mar. 30, 2011, directed to Korean Application No. 10-2009-7004683; 7 pages.
Hirose, J. et al., U.S. Office Action mailed Feb. 7, 2012, directed to U.S. Appl. No. 13/038,849; 11 pages.
Chinese Notification of First Office Action dated Dec. 19, 2011, directed to Chinese Application No. 200910178369.0; 21 pages.
Japanese Notification of Reasons for Refusal mailed Jan. 10, 2012, directed to Japanese Application No. 2007-006229; 6 pages.
Japanese Notification of Reasons for Refusal mailed Feb. 2, 2012, directed to Japanese Application No. 2007-006224; 6 pages.
Notification of First Office Action dated Mar. 28, 2012, directed to Chinese Application No. 201110049758.0; 13 pages.
Fukuda et al., Office Action dated Apr. 26, 2012, directed to U.S. Appl. No. 12/439,992; 11 pages.
Notification of First Office Action dated May 2, 2012, directed to Chinese Application No. 200910178370.3; 9 pages.

【Fig. 1】
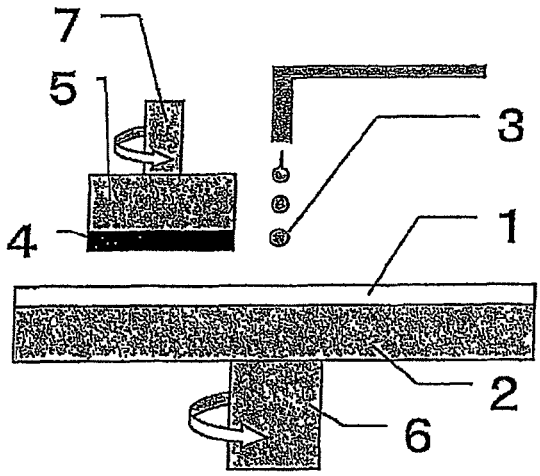
【Fig. 2】
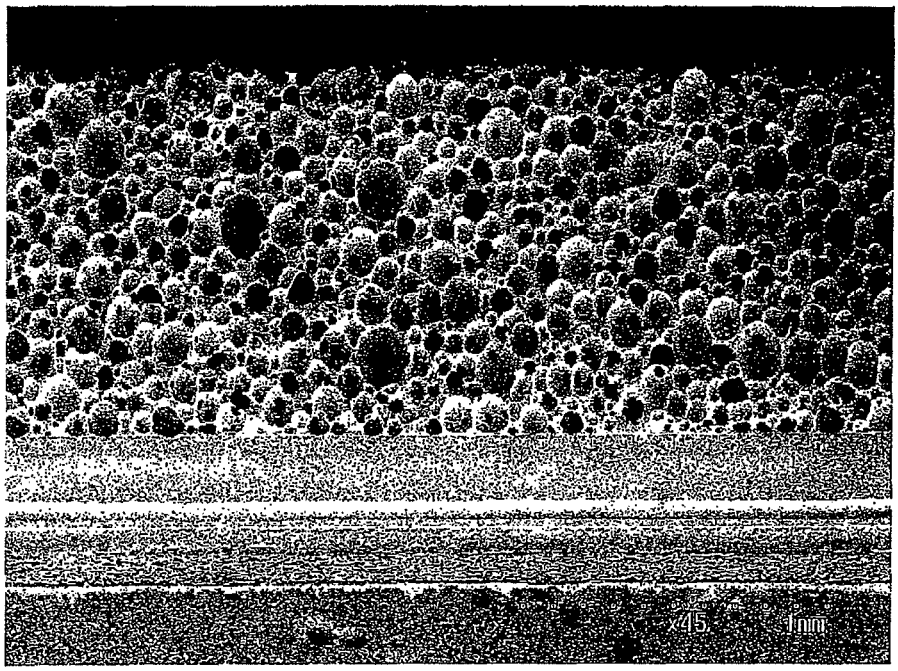

【Fig. 3】
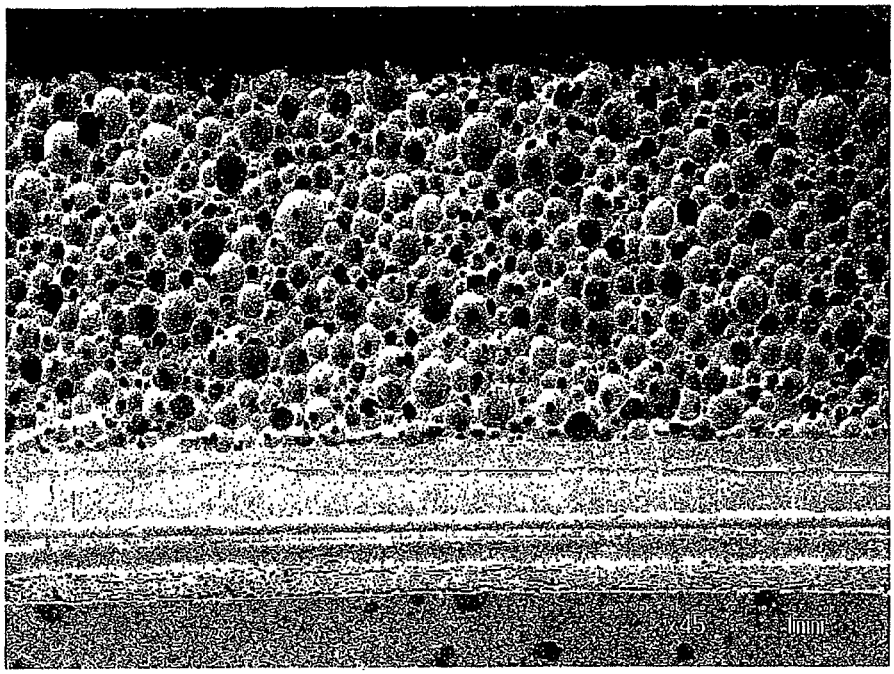

POLISHING PAD AND A METHOD FOR MANUFACTURING THE SAME

REFERENCE TO RELATED APPLICATIONS

This application is a national stage application under 35 USC 371 of International Application No. PCT/JP2007/072852, filed Nov. 27, 2007, which claims the priority of Japanese Patent Application Nos. 2007-006218, filed Jan. 15, 2007, 2007-006224, filed Jan. 15, 2007, 2007-006229, filed Jan. 15, 2007, and 2007-006232, filed Jan. 15, 2007, the contents of all of which prior applications are incorporated herein by reference.

FIELD OF THE INVENTION

The present invention relates to a polishing pad which can perform, stably with high polishing efficiency, planarization processing of optical materials such as reflecting mirrors etc., silicon wafers, glass substrates for hard disks, aluminum substrates etc. and materials requiring high degree of surface flatness such as general metal polishing processing, as well as a method for manufacturing the polishing pad. The polishing pad of the present invention is useful particularly for final polishing of silicon wafers and glass.

BACKGROUND OF THE INVENTION

Generally, the mirror polishing of semiconductor wafers such as a silicon wafer etc., lenses, and glass substrates includes rough polishing primarily intended to regulate planarity and in-plane uniformity and final polishing primarily intended to improve surface roughness and removal of scratches.

The final polishing is carried out usually by rubbing a wafer against an artificial suede made of flexible urethane foam stuck to a rotatable platen and simultaneously feeding thereon an abrasive containing a colloidal silica in an alkali-based aqueous solution (Patent Literature 1).

As the polishing pad for finishing used in final polishing, the following polishing pads have been proposed besides those described above.

A suede finishing polishing pad comprising a nap layer having a large number of long and thin holes (naps) formed with a foaming agent in the thickness direction, in polyurethane resin, and a foundation cloth for reinforcing the nap layer is proposed (Patent Literature 2).

A suede abrasive cloth for final polishing, in which surface roughness is expressed as an arithmetic average roughness (Ra) of 5 μm or less, is proposed (Patent Literature 3).

An abrasive cloth for final polishing, which is provided with a base material part and a surface layer (nap layer) formed on the base material part, wherein a polyvinyl halide or vinyl halide copolymer is contained in the surface layer, is proposed (Patent Literature 4).

Conventional polishing pads for finishing have been produced by a wet curing method. The wet curing method is a method wherein an urethane resin solution obtained by dissolving urethane resin in a water-soluble organic solvent such as dimethylformamide is applied onto a base material, then wet-solidified by treatment in water, to form a porous grain side layer, which is then washed with water and dried, followed by polishing of the grain side layer to form a surface layer (nap layer). In Patent Literature 5, for example, an abrasive cloth for finishing, having roughly spherical holes having an average particle diameter of 1 to 30 μm, is produced by the wet curing method.

In the wet curing method, however, there is a problem that a large amount of metal impurity-free purified water should be used, tremendous investment in plant and equipment is necessary, and production costs are very high. Because a solvent should be used, there is another problem of high environmental burden. In the conventional polishing pads, cells have a thin and long structure, or the material of the surface layer itself is poor in mechanical strength, and thus there are problems such as poor durability, gradual deterioration in planarizing characteristics, and inferior stability of removal rate. In addition, the conventional polishing pads have a problem of easy interfacial release of a polishing layer from a base material layer because of low adhesion therebetween. The conventional polishing pads have a problem of easy clogging on the surface of the pad during polishing because of interior self-dressing.

Patent Literature 1: JP-A 2003-37089
Patent Literature 2: JP-A 2003-100681
Patent Literature 3: JP-A 2004-291155
Patent Literature 4: JP-A 2004-335713
Patent Literature 5: JP-A 2006-75914

SUMMARY OF THE INVENTION

The object of the first invention is to provide a polishing pad excellent in durability and in the adhesiveness between a polishing layer and a base material layer. The object of the second invention is to provide a polishing pad excellent in durability, in self-dressing and in the adhesiveness between a polishing layer and a base material layer. The object of the third invention is to provide a method for inexpensively and easily manufacturing a polishing pad very excellent in durability and stability of a removal rate. The object of the fourth invention is to provide a polishing pad excellent in durability.

The present inventors made extensive study to solve the problem described above, and as a result, they found that the object can be achieved by the following polishing pad and reached completion of the present invention.

[First Invention]

That is, the first invention relates to a polishing pad comprising a polishing layer arranged on a base material layer, wherein the polishing layer comprises a thermosetting polyurethane foam having roughly spherical interconnected cells having an average cell diameter of 20 to 300 μm, the polyurethane foam comprises an isocyanate component and an active hydrogen-containing compound as starting components, and the active hydrogen-containing compound comprises 30 to 85% by weight of a high-molecular-weight polyol having 2 to 4 functional groups and a hydroxyl value of 20 to 100 mg KOH/g.

It is believed that the conventional polishing pads, upon repeated application of pressure to the polishing layer, are liable to "collapse" and are poor in durability because cells of the polishing pads have a thin and long structure or the material of the polishing layer itself is poor in mechanical strength. On the other hand, when a thermosetting polyurethane foam having roughly spherical interconnected cells having an average cell diameter of 20 to 300 μm is used to form a polishing layer as described above, the durability of the polishing layer can be improved. Accordingly, when the polishing pad of the first present invention is used, planarizing characteristics can be kept high for a long period of time, and the stability of a removal rate can be also improved. The polishing pad is also excellent in an ability to maintain slurry because of its interconnected cell structure. The term "roughly spherical" refers to sphere-shaped and oval sphere-shaped. Oval sphere-shaped cells are those having a ratio of a major axis L/minor axis S(L/S) of 5 or less, preferably 3 or less, more preferably 1.5 or less.

When the average cell diameter deviates from the range of 20 to 300 μm, removal rate and durability are reduced.

The active hydrogen-containing compound that is a material for forming the thermosetting polyurethane foam contains 30 to 85% by weight of a high-molecular-weight polyol having 2 to 4 functional groups and a hydroxyl value of 20 to 100 mg KOH/g. By using the high-molecular-weight polyol in the specified amount, objective interconnected cells can be stably formed, and the mechanical characteristics of the polishing layer are improved. When the number of functional groups is 5 or more, the degree of crosslinking of the thermosetting polyurethane foam becomes so high that the foam becomes too brittle and the surface of a material to be polished is easily scratched. When the hydroxyl value is less than 20 mg KOH/g, the amount of a hard segment in the polyurethane is reduced so that durability tends to be reduced, while when the hydroxyl value is greater than 100 mg KOH/g, the degree of crosslinking of the thermosetting polyurethane foam becomes so high that the foam becomes too brittle and the surface of a material to be polished is easily scratched.

Preferably, the high-molecular-weight polyol comprises 20 to 100% by weight of a polymer polyol in which particles of at least one polymer selected from the group consisting of polystyrene, polyacrylonitrile and a styrene-acrylonitrile copolymer are dispersed. By using the polymer polyol in the specified amount, cell films are easily broken and the objective interconnected cells are easily formed.

The active hydrogen-containing compound preferably contains 2 to 15% by weight of a low-molecular-weight polyol having a hydroxyl value of 400 to 1830 mg KOH/g and/or a low-molecular-weight polyamine having an amine value of 400 to 1870 mg KOH/g. By using the low-molecular-weight polyol and low-molecular-weight polyamine having a high hydroxyl or amine value together with the high-molecular-weight polyol having a hydroxyl value of 20 to 100 mgKOH/g, cell films are easily broken and the objective interconnected cells are easily formed. When the hydroxyl value is less than 400 mg KOH/g or the amine value is less than 400 mg KOH/g, an effect of improving formation of interconnected cells cannot be sufficiently obtained. On the other hand, when the hydroxyl value is greater than 1830 mg KOH/g or the amine value is greater than 1870 mgKOH/g, the thermosetting polyurethane foam becomes so rigid that the surface of a material to be polished is easily scratched. When the low-molecular-weight polyol and the low-molecular-weight polyamine are simultaneously used, they are used in a total amount of 2 to 15% by weight.

The thermosetting polyurethane foam may contain closed cells together with the above-mentioned interconnected cells, and the interconnected cell rate of the polyurethane foam is preferably 50% or more, more preferably 60% or more.

Preferably the active hydrogen-containing compound contains 5 to 60% by weight of a polyester polyol. By adding the polyester polyol, the adhesiveness between the polishing layer and the base material layer is significantly improved. When the amount of the polyester polyol incorporated is less than 5% by weight, the adhesiveness between the polishing layer and the base material layer is hardly improved, while when the amount is greater than 60% by weight, the polishing layer becomes too brittle and the lifetime of the pad tends to be reduced.

The first invention also relates to a method for manufacturing a polishing pad, comprising steps of preparing a cell-dispersed urethane composition comprising an isocyanate component and an active hydrogen-containing compound containing 30 to 85% by weight of a high-molecular-weight polyol having 2 to 4 functional groups and a hydroxyl value of 20 to 100 mg KOH/g as starting components by mechanical foaming method, coating a base material layer with the cell-dispersed urethane composition, curing the cell-dispersed urethane composition to form a thermosetting polyurethane foam layer having roughly spherical interconnected cells having an average cell diameter of 20 to 300 μm, and uniformly regulating the thickness of the thermosetting polyurethane foam layer.

The first invention also relates to a method for manufacturing a polishing pad, comprising steps of preparing a cell-dispersed urethane composition comprising an isocyanate component and an active hydrogen-containing compound containing 30 to 85% by weight of a high-molecular-weight polyol having 2 to 4 functional groups and a hydroxyl value of 20 to 100 mg KOH/g as starting components by mechanical foaming method, coating a release sheet with the cell-dispersed urethane composition, laminating a base material layer on the cell-dispersed urethane composition, curing the cell-dispersed urethane composition while keeping the thickness thereof uniform with a pressing means to form a thermosetting polyurethane foam layer having roughly spherical interconnected cells having an average cell diameter of 20 to 300 μm, and releasing the release sheet under the thermosetting polyurethane foam layer.

[Second Invention]

The second invention relates to a polishing pad comprising a polishing layer arranged on a base material layer, wherein the polishing layer comprises a thermosetting polyurethane foam having roughly spherical interconnected cells having an average cell diameter of 20 to 300 μm, the polyurethane foam comprises an isocyanate component and an active hydrogen-containing compound as starting components, and the active hydrogen-containing compound comprises 1 to 20% by weight of a low-molecular-weight polyol having 3 to 8 functional groups and a hydroxyl value of 400 to 1830 mg KOH/g and/or a low-molecular-weight polyamine having 3 to 8 functional groups and an amine value of 400 to 1870 mg KOH/g.

By forming a polishing layer from the thermosetting polyurethane foam having roughly spherical interconnected cells having an average cell diameter of 20 to 300 μm, the durability of the polishing layer can be improved. Accordingly, when the polishing pad of the second invention is used, planarization characteristics can be kept high for a long time and the removal rate stability can also be improved. The polishing pad is also excellent in an ability to maintain slurry because of its interconnected cell structure. The term "roughly spherical" refers to sphere-shaped and oval sphere-shaped. Oval sphere-shaped cells are those having a ratio of a major axis L/minor axis S(L/S) of 5 or less, preferably 3 or less, more preferably 1.5 or less.

When the average cell diameter deviates from the range of 20 to 300 μm, removal rate and durability are reduced.

The active hydrogen-containing compound that is a material for forming the thermosetting polyurethane foam contains 1 to 20% by weight of a low-molecular-weight polyol having 3 to 8 functional groups and a hydroxyl value of 400 to 1830 mg KOH/g and/or a low-molecular-weight polyamine having 3 to 8 functional groups and an amine value of 400 to 1870 mg KOH/g. By using the low-molecular-weight polyol and/or the low-molecular-weight polyamine in the specified amount, cell films are easily broken and interconnected cells are easily formed, and the removal rate stability is improved. Because the multifunctional low-molecular-weight polyol and low-molecular-weight polyamine are used, polyurethane having a developed crosslinked structure is formed thereby improving self-dressing and hardly undergoing clogging on the surface of the pad during polishing.

When the number of functional groups is less than 3, the crosslinked structure of polyurethane is not sufficiently developed thus making self-dressing insufficient, while when the number of functional groups is greater than 8, the crosslinked structure of polyurethane is so developed that the polyurethane is made too brittle and the polishing characteristics are adversely affected.

When the hydroxyl value is less than 400 mg KOH/g or the amine value is less than 400 mg KOH/g, an effect of improving formation of interconnected cells cannot be sufficiently obtained. On the other hand, when the hydroxyl value is greater than 1830 mg KOH/g or the amine value is greater than 1870 mg KOH/g, the thermosetting polyurethane foam becomes so rigid that the surface of a material to be polished is easily scratched.

When the low-molecular-weight polyol and the low-molecular-weight polyamine are simultaneously used, they are used in a total amount of 1 to 20% by weight.

It is preferable that the low-molecular-weight polyol is at least one member selected from the group consisting of trimethylolpropane, glycerin, diglycerin, 1,2,6-hexanetriol, triethanolamine, pentaerythritol, tetramethylol cyclohexane, methylglycoside, and alkylene oxide adducts thereof, and the low-molecular-weight polyamine is at least one member selected from the group consisting of ethylene diamine, tolylene diamine, diphenylmethane diamine, and alkylene oxide adducts thereof.

The active hydrogen-containing compound preferably contains 30 to 85% by weight of a high-molecular-weight polyol having 2 to 4 functional groups and a hydroxyl value of 20 to 150 mg KOH/g. By using the high-molecular-weight polyol in the specified amount, objective interconnected cells can be stably formed, and the mechanical characteristics of the polishing layer are improved.

In the second invention, the isocyanate component that is a material for forming the thermosetting polyurethane foam is preferably carbodiimide-modified MDI. By using the low-molecular-weight polyol and/or the low-molecular-weight polyamine in combination with carbodiimide-modified MDI, the adhesiveness between the polishing layer and the base material layer is significantly improved.

The second invention also relates to a method for manufacturing a polishing pad, comprising steps of preparing a cell-dispersed urethane composition comprising carbodiimide-modified MDI and an active hydrogen-containing compound containing 1 to 20% by weight of a low-molecular-weight polyol having 3 to 8 functional groups and a hydroxyl value of 400 to 1830 mg KOH/g and/or a low-molecular-weight polyamine having 3 to 8 functional groups and an amine value of 400 to 1870mg KOH/gas starting components by mechanical foaming method, coating a base material layer with the cell-dispersed urethane composition, curing the cell-dispersed urethane composition to form a thermosetting polyurethane foam layer having roughly spherical interconnected cells having an average cell diameter of 20 to 300 μm, and uniformly regulating the thickness of the thermosetting polyurethane foam layer.

Further, the second invention relates to a method for manufacturing a polishing pad, comprising steps of preparing a cell-dispersed urethane composition comprising carbodiimide-modified MDI and an active hydrogen-containing compound containing 1 to 20% by weight of a low-molecular-weight polyol having 3 to 8 functional groups and a hydroxyl value of 400 to 1830 mg KOH/g and/or a low-molecular-weight polyamine having 3 to 8 functional groups and an amine value of 400 to 1870 mg KOH/g as starting components by mechanical foaming method, coating a release sheet with the cell-dispersed urethane composition, laminating a base material layer on the cell-dispersed urethane composition, curing the cell-dispersed urethane composition while keeping the thickness thereof uniform with a pressing means to form a thermosetting polyurethane foam layer having roughly spherical interconnected cells having an average cell diameter of 20 to 300 μm, and releasing the release sheet under the thermosetting polyurethane foam layer.

[Third Invention]

On one hand, the third invention relates to a method for manufacturing a polishing pad, comprising steps of preparing a cell-dispersed urethane composition by mechanical foaming method, coating a release sheet with the cell-dispersed urethane composition, laminating a base material layer on the cell-dispersed urethane composition, curing the cell-dispersed urethane composition while keeping the thickness thereof uniform with a pressing means to form a polyurethane foam layer having roughly spherical interconnected cells, and releasing the release sheet in the lower-surface side of the polyurethane foam layer.

As described above, a polyurethane foam layer (polishing layer) having roughly spherical (sphere-shaped and oval sphere-shaped) interconnected cells can be formed extremely easily by dispersing a gas such as air as fine cells in the starting material by a mechanical foaming method (including a mechanical frothing method) to prepare a cell disperse durethane composition and then curing the cell dispersed urethane composition. In the mechanical foaming method of the present invention, a gas such as air is dispersed without being dissolved in the starting material, and thus there is an advantage that generation of new cells (post expansion phenomenon), after a step of uniformly regulating the thickness of the polyurethane foam layer, can be suppressed and thickness accuracy and specific gravity can be easily controlled. In addition, the mechanical foaming method does not necessitate use of a foaming agent such as a solvent or Freon and is thus not only excellent in costs but also preferable from an environmental viewpoint.

The polyurethane foam layer has roughly spherical cells and is thus excellent in durability. Accordingly, when a material to be polished is polished with a polishing pad having the foam layer, the removal rate stability is improved.

The manufacturing method of the third invention is characterized in that the lower-surface material is used as a release sheet while the upper-surface material is used as a base material layer, and the release sheet in the lower-surface side of the resulting polyurethane foam layer is released. It was found that when a polyurethane foam layer is formed by the mechanical foaming method as described above, a fluctuation of cells is lower in the lower-surface side than in the upper-surface side of the polyurethane foam layer. As described above, the lower-surface side of the formed polyurethane foam layer is used as a polishing surface, and the polishing surface has a lower fluctuation of cells, thereby further improving the removal rate stability.

In the polishing pad of the third invention, it is preferable that when 3 lines by which the polyurethane foam layer is divided in the thickness direction into quarters are designated a first line, a second line and a third line in the direction of from the polishing surface to the base material layer, the cell diameter distribution (maximum cell diameter/minimum cell diameter) in the first line is the smallest and the cell diameter distribution in the third line is the largest. That is, the cell diameter distribution of the polyurethane foam layer is preferably increased in the direction of from the polishing surface to the base material layer. The cell diameter distribution in the first line is preferably 3.5 or less. When the cell diameter distribution in the first line is 3.5 or less, sufficient removal rate stability is obtained. From the viewpoint of polishing properties, the average value of the average cell diameters in the first to third lines is preferably 35 to 300 μm.

[Fourth Invention]

Further, the fourth invention relates to a method for manufacturing a polishing pad, comprising steps of preparing a cell-dispersed urethane composition by mechanical foaming method, coating a sheet A having a nitrogen gas permeability rate of $1\times10^{-7}$ [$cm^3/cm^2\cdot s\cdot cmHg$] or less with the cell-dispersed urethane composition, laminating a sheet B having a nitrogen gas permeability rate of $1\times10^{-7}$ [$cm^3/cm^2\cdot s\cdot cmHg$] or less on the coated cell-dispersed urethane composition, and curing the cell-dispersed urethane composition while keeping the thickness thereof uniform with a pressing means to form a thermosetting polyurethane foam layer with interconnected cells.

As described above, a gas such as air is dispersed as fine cells in the starting material by the mechanical foaming method to prepare a cell-dispersed urethane composition, and the cell-dispersed urethane composition is cured, whereby a polyurethane foam layer (polishing layer) having interconnected cells having a spherical shape (including an oval shape) with a very small cell diameter. In the mechanical foaming method of the fourth present invention, a gas such as air is dispersed without being dissolved in the starting material, and thus there is an advantage that generation of new cells (post expansion phenomenon), after a step of uniformly regulating the thickness of the polyurethane foam layer, can be suppressed and thickness accuracy and specific gravity can be easily controlled. In addition, the mechanical foaming method does not necessitate use of a foaming agent such as a solvent or Freon and is thus not only excellent in costs but also preferable from an environmental viewpoint.

In the manufacturing method of the fourth invention, sheets A and B each having a nitrogen gas permeability rate of $1\times10^{-7}$ [$cm^3/cm^2\cdot s\cdot cmHg$] or less are laminated with each other, so that upon breakage of fine cells in the cell-dispersed urethane composition to form interconnected cells, the gas in the fine cells can be retained in the composition and prevented from being discharged into the external environment. The thickness of the cell-dispersed urethane composition can thereby be prevented from changing during the curing step, and the surface accuracy of the polyurethane foam layer after curing can be made high.

In the manufacturing method of the fourth invention, the curing step comprises at least first curing and second curing, and the first curing is at a curing temperature of 30 to 50° C. for a curing time of 5 to 60 minutes, and the second curing is at a curing temperature of 60 to 80° C. for a curing time of 30 minutes or more. By conducting curing in multiple steps, fine and highly uniform interconnected cells can be formed. When curing is conducted in one stage, the cell diameter is easily increased, and the durability of the polishing pad tends to be decreased. When the curing is conducted outside of the conditions described above, fine and highly uniform interconnected cells cannot be formed, and the removal rate stability tends to be deteriorated.

In the fourth invention, the sheets A and B are preferably polyethylene terephthalate sheets. Particularly, PET is a preferable material because of its low nitrogen gas permeability rate.

The polishing layer of the polishing pad of the fourth invention is excellent in durability because of its spherical fine cells. Accordingly, when a material to be polished is polished with the polishing pad, the removal rate stability is improved.

The first to fourth present invention also relate to a method for manufacturing a semiconductor device, which comprises a step of polishing the surface of a semiconductor wafer with the polishing pad described above.

BRIEF DESCRIPTION OF DRAWINGS

FIG. 1 is a schematic illustration showing one example of a conventional polishing apparatus used in CMP polishing.

FIG. 2 is a photomicrograph (SEM photograph) of the polishing pad in Example 1 of the third present invention.

FIG. 3 is a photomicrograph (SEM photograph) of the polishing pad in Comparative Example 1 of the third present invention.

DETAILED DESCRIPTION OF THE INVENTION

The polishing pad of the first and second present invention comprise a base material layer and a polishing layer made of a thermosetting polyurethane foam (hereinafter referred to as polyurethane foam) having roughly spherical interconnected cells having an average cell diameter of 20 to 300 μm.

The polyurethane resin is a preferable material for forming the polishing layer because it is excellent in abrasion resistance, a polyurethane polymer having desired physical properties can be easily obtained by changing its raw material composition, and roughly spherical fine cells can be easily formed by a mechanical foaming method (including a mechanical frothing method).

The polyurethane resin comprises an isocyanate component and an active hydrogen-containing compound (high-molecular-weight polyol, low-molecular-weight polyol, low-molecular-weight polyamine and chain extender etc.).

As the isocyanate component, a compound known in the field of polyurethane can be used without particular limitation. The isocyanate component includes, for example, aromatic diisocyanates such as 2,4-toluene diisocyanate, 2,6-toluene diisocyanate, 2,2'-diphenyl methane diisocyanate, 2,4'-diphenyl methane diisocyanate, 4,4'-diphenyl methane diisocyanate, polymeric MDI, carbodiimide-modified MDI (for example, Millionate MTL made by Nippon Polyurethane Industry Co., Ltd.), 1,5-naphthalene diisocyanate, p-phenylene diisocyanate, m-phenylene diisocyanate, p-xylylene diisocyanate and m-xylylene diisocyanate, aliphatic diisocyanates such as ethylene diisocyanate, 2,2,4-trimethyl hexamethylene diisocyanate and 1,6-hexamethylene diisocyanate, and cycloaliphatic diisocyanates such as 1,4-cyclohexane diisocyanate, 4,4'-dicyclohexyl methane diisocyanate, isophorone diisocyanate and norbornane diisocyanate. These may be used alone or as a mixture of two or more thereof.

As the isocyanate component, it is possible to use not only the above-described diisocyanate compounds but also multifunctional (trifunctional or more) polyisocyanates. As the multifunctional isocyanate compounds, a series of diisocyanate adduct compounds are commercially available as Desmodul-N (Bayer) and Duranate™ (Asahi Chemical Industry Co., Ltd.).

Among the isocyanate components described above, aromatic diisocyanates such as 4,4'-diphenylmethane diusocyanate are preferably used, and particularly carbodiimide-modified MDI is preferably used.

As the high-molecular-weight polyol, a compound known in the field of polyurethane can be used without particular limitation. The high-molecular-weight polyol includes, for example, polyether polyols represented by polytetramethylene ether glycol and polyethylene glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a multivalent alcohol and reacting the resulting reaction mixture with an organic dicarboxylic acid, polycarbonate polyols obtained by ester exchange reaction of a polyhydroxyl compound with aryl carbonate, and polymer polyols such as polyether polyol in which polymer particles are dispersed. These may be used singly or as a mixture of two or more thereof.

In the first invention, a high-molecular-weight polyol having 2 to 4 functional groups and a hydroxyl value of 20 to 100 mg KOH/g should be used in an amount of 30 to 85% by weight based on the whole of the active hydrogen-containing compound. The hydroxyl value of the high-molecular-weight polyol is preferably 20 to 60 mg KOH/g, and the amount of the high-molecular-weight polyol incorporated is preferably 35 to 80% by weight.

Among the high-molecular-weight polyols described above, it is preferable to use a polymer polyol in which particles of at least one polymer selected from the group consisting of polystyrene, polyacrylonitrile and a styrene-acrylonitrile copolymer are dispersed. The amount of the polymer polyol incorporated is preferably 20 to 100% by weight, more preferably 50 to 100% by weight based on the whole of the high-molecular-weight polyol. The content of the polymer particles in the polymer polyol is preferably 1 to 20% by weight, more preferably 1 to 10% by weight.

Among the high-molecular-weight polyols described above, a polyester polyol is preferably used. The amount of the polyester polyol incorporated is preferably 5 to 60% by weight, more preferably 10 to 50% by weight based on the whole of the active hydrogen-containing compound.

In the second invention, a high-molecular-weight polyol having 2 to 4 functional groups and a hydroxyl value of 20 to 150 mg KOH/g is preferably used. The hydroxyl value is more preferably 50 to 120 mg KOH/g. When the hydroxyl value is less than 20 mg KOH/g, the amount of a hard segment in the polyurethane is reduced so that durability tends to be reduced, while when the hydroxyl value is greater than 150 mg KOH/g, the degree of crosslinking of the polyurethane foam becomes so high that the polyurethane foam tends to be brittle. The high-molecular-weight polyol is used in an amount of preferably 30 to 85% by weight, more preferably 30 to 60% by weight, based on the whole of the active hydrogen-containing compound.

To produce the polyurethane foam layer having an interconnected cell structure in the third invention, a polymer polyol is preferably used, and particularly a polymer polyol in which polymer particles comprising acrylonitrile and/or a styrene-acrylonitrile copolymer are dispersed is preferably used. This polymer polyol is contained in an amount of preferably 20 to 100% by weight, more preferably 30 to 60% by weight in the whole polymer polyol used. The high-molecular-weight polyol (including the polymer polyol) is contained in an amount of 60 to 85% by weight, more preferably 70 to 80% by weight in the active hydrogen-containing compound. By using the high-molecular-weight polyol in the specified amount, cell films are easily broken to easily form an interconnected cell structure.

Among the high-molecular-weight polyols, a high-molecular-weight polyol having a hydroxyl value of 20 to 100 mg KOH/g is preferably used. The hydroxyl value is more preferably 25 to 60 mg KOH/g. When the hydroxyl value is less than 20 mgKOH/g, the amount of a hard segment in the polyurethane is reduced so that durability tends to be reduced, while when the hydroxyl value is greater than 100 mg KOH/g, the degree of crosslinking of the polyurethane foam becomes so high that the foam tends to be brittle.

Among the high-molecular-weight polyols described above, a high-molecular-weight polyol having 2 to 4 functional groups and a hydroxyl value of 20 to 100 mg KOH/g is preferably used in the fourth invention. The hydroxyl value is more preferably 25 to 60 mg KOH/g. By using the high-molecular-weight polyol, objective interconnected cells can be stably formed, and the mechanical characteristics of the polishing layer are improved. When the number of functional groups is 5 or more, the degree of crosslinking of the thermosetting polyurethane foam becomes so high that the foam becomes too brittle and the surface of a material to be polished is easily scratched. When the hydroxyl value is less than 20 mg KOH/g, the amount of a hard segment in the polyurethane is reduced so that durability tends to be reduced, while when the hydroxyl value is greater than 100 mg KOH/g, the degree of crosslinking of the thermosetting polyurethane foam becomes so high that the foam becomes too brittle and the surface of a material to be polished is easily scratched.

A polymer polyol is also preferably used, and particularly a polymer polyol in which polymer particles comprising acrylonitrile and/or a styrene-acrylonitrile copolymer are dispersed is preferably used. This polymer polyol is contained in an amount of preferably 20 to 100% by weight, more preferably 30 to 60% by weight in the whole of the high-molecular-weight polyols used.

These specific high-molecular-weight polyols are contained in an amount of 60 to 85% by weight, more preferably 70 to 80% by weight in the active hydrogen-containing compound. By using the specific high-molecular-weight polyol in the specified amount, cell films are easily broken and objective interconnected cells are easily formed.

A number-average molecular weight of the high-molecular-weight polyol is not particularly limited, but is preferably 1500 to 6000, from the viewpoint of the elastic characteristics of the resulting polyurethane. When the number-average molecular weight is less than 1500, the polyurethane obtained therefrom does not have sufficient elastic characteristics, thus easily becoming a brittle polymer. Accordingly, a foam layer made of this polyurethane is rigid to easily cause scratch of the polished surface of an object to be polished. On the other hand, when the number-average molecular weight is higher than 6000, polyurethane obtained therefrom becomes too soft. Therefore, a foam layer made of this polyurethane tends to be inferior in durability.

Examples of the low-molecular-weight polyol that can be used together with a high-molecular-weight polyol described above include: ethylene glycol, 1,2-propylene glycol, 1,3-propylene glycol, 1,2-butanediol, 1,3-butanediol, 1,4-butanediol, 2,3-butanediol,1,6-hexanediol, neopentyl glycol, 1,4-cyclohexanedimethanol, 3-methyl-1,5-pentanediol, diethylene glycol, triethyleneglycol, 1,4-bis(2-hydroxyethoxy)benzene, trimethylolpropane, glycerin, 1,2,6-hexanetriol, pentaerythritol, tetramethylol cyclohexane, methyl glucoside, sorbitol, mannitol, dulcitol, sucrose, 2,2,6,6-tetrakis(hydroxymethyl)cyclohexanol, diethanolamine, N-methyldiethanolamine, triethanolamine and the like. Other examples that can be used together with the high-molecular-weight polyol also include: low-molecular-weight polyamine such as ethylenediamine, tolylenediamine, diphenylmethanediamine, diethylenetriamine and the like. Polyols to which alkylene oxides such as ethylene oxide and propylene oxide are added to the low-molecular-weight polyol or low-molecular-weight polyamine described above may be used together with a high-molecular-weight polyol described above. Still other examples that can be used together with the high-molecular-weight polyol also include: alcoholamines such as monoethanolamine, 2-(2-aminoethylamino) ethanol, monopropanolamine and the like. These low-molecular-weight polyols, high-molecular-weight polyamines etc. may be used alone or as a mixture of two or more thereof.

In the first and third inventions, among these compounds, a low-molecular-weight polyol having a hydroxyl value of 400 to 1830 mg KOH/g and/or a low-molecular-weight polyamine having an amine value of 400 to 1870 mg KOH/g are preferably used. The hydroxyl value is more preferably 700 to 1250 mg KOH/g, and the amine value is more preferably 400 to 950 mg KOH/g. When the hydroxyl value is less than 400 mg KOH/g or the amine value is less than 400 mg KOH/g, an effect of improving formation of interconnected cells tends to be not sufficiently obtained. On the other hand, when the hydroxyl value is greater than 1830 mg KOH/g or the amine value is greater than 1870 mg KOH/g, a wafer tends to be easily scratched on the surface. Particularly, diethylene glycol, triethylene glycol or 1,4-butanediol is preferably used.

To form the polyurethane foam (the foam layer) having an interconnected cell structure, the low-molecular-weight polyol, the low-molecular-weight polyamine and the alcohol amine are contained in the total amount of preferably 2 to 15 wt %, more preferably 5 to 10 wt %, in the active hydrogen-containing compound. By using the low-molecular-weight polyol etc. in specified amounts, cell films are easily broken to easily form an interconnected cell structure and further the mechanical characteristics of the polyurethane foam are improved.

In the second invention, it is necessary that together with the high-molecular-weight polyol, a low-molecular-weight polyol having 3 to 8 functional groups and a hydroxyl value of 400 to 1830 mg KOH/g and/or a low-molecular-weight polyamine having 3 to 8 functional groups and an amine value of 400 to 1870 mg KOH/g is used in an amount of 1 to 20% by weight based on the whole of the active hydrogen-containing compound. The amount of the low-molecular-weight polyol and/or the low-molecular-weight polyamine added is preferably 5 to 15% by weight.

The low-molecular-weight polyol having the number of functional groups and the above hydroxyl value includes, for example, trimethylolpropane, glycerin, diglycerin, 1,2,6-hexanetriol, triethanolamine, pentaerythritol, tetramethylol cyclohexane, methylglucoside, and alkylene oxide (EO, PO etc.) adducts thereof. These may be used alone or as a mixture of two or more thereof. Particularly, trimethylolpropane is preferably used.

The low-molecular-weight polyamine having the above number of functional groups and the above amine value includes, for example, ethylene diamine, tolylene diamine, diphenylmethanediamine, and alkylene oxide (EO, PO etc.) adducts thereof. These may be used alone or as a mixture of two or more thereof. Particularly, an EO adduct of ethylene diamine is preferably used.

In the case where a polyurethane foam is produced by means of a prepolymer method, a chain extender is used in curing of a prepolymer. A chain extender is an organic compound having at least two active hydrogen groups and examples of the active hydrogen group include: a hydroxyl group, a primary or secondary amino group, a thiol group (SH) and the like. Concrete examples of the chain extender include: polyamines such as 4,4'-methylenebis(o-chloroaniline) (MOCA), 2,6-dichloro-p-phenylenediamine, 4,4'-methylenebis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, polytetramethylene oxide-di-p-aminobenzoate, 4,4'-diamino-3,3',5,5,'-tetraethyldiphenylmethane, 4,4'-diamino-3,3'-diisopropyl-5,5'-dimethyldiphenylmethane, 4,4'-diamino-3,3',5,5'-tetraisopropyldiphenylmethane, 1,2-bis(2-aminophenylthio) ethane, 4,4'-diamino-3,3'-diethyl-5,5'-dimethyldiphenylmethane, N,N'-di-sec-butyl-4,4'-diaminophenylmethane, 3,3'-diethyl-4,4'-diaminodiphenylmethane, m-xylylenediamine, N,N'-di-sec-butyl-p-phenylenediamine, m-phenylenediamine and p-xylylenediamine; low-molecular-weight polyol component; and a low-molecular-weight polyamine component. The chain extenders described above may be used either alone or in mixture of two kinds or more.

In the first and fourth inventions, the average hydroxyl value (OHVav) of the active hydrogen-containing compound used is preferably in the range of the following formula:

$$(350-80\times fav-120/fav)\leqq OHVav\leqq(350-80\times fav+120/fav)$$

In the above formula, OHVav and fav (average number of functional groups) are calculated according to the following equation:

$$OHVav=\sum_{i=1}^{n}(ai\times ci)\Big/\sum_{i=1}^{n}ci \quad \text{[equation 1]}$$

$$fav=\sum_{i=1}^{n}(bi\times ci)\Big/\sum_{i=1}^{n}ci \quad \text{[equation 2]}$$

wherein n is the number of polyol components, ai is a hydroxyl value, bi is the number of functional groups, and ci is parts by weight of each polyol component added.

For example, if in the active hydrogen-containing compound used, there are first to $n^{th}$ polyol components, then the hydroxyl value of the first polyol component denotes al, the number of functional groups in the first polyol component denotes b1, and the amount of the first polyol component added denotes c1, . . . , the hydroxyl value of the $n^{th}$ polyol component denotes an, the number of functional groups in the $n^{th}$ polyol component denotes bn, and the amount of the $n^{th}$ polyol component added denotes cn. However, the polymer polyol has polymer particles dispersed therein, and thus it is assumed that regardless of its type, the number of functional groups therein is assumed to be 3.

When the polyurethane is produced by the prepolymer method, the type and compounding ratio of the active hydrogen-containing compound used in the synthesis and curing of an isocyanate-terminated prepolymer are not particularly limited, but it is preferable that when an isocyanate-terminated prepolymer is synthesized, the high-molecular-weight polyol is used preferably in an amount of 80% by weight or more in the active hydrogen-containing compound, and when the isocyanate-terminated prepolymer is cured, the low-molecular-weight polyol and/or the low-molecular-weight polyamine is used preferably in an amount of 80% by weight or more in the active hydrogen-containing compound. Use of the active hydrogen-containing compound containing the different components in the different stages is preferable from the viewpoint of the physical property stability and productivity of the resulting polyurethane.

A ratio between an isocyanate component and an active hydrogen-containing compound in the invention can be altered in various ways according to molecular weights thereof, desired physical properties of polyurethane foam and the like. In order to obtain polyurethane foam with desired polishing characteristics, a ratio of the number of isocyanate groups in an isocyanate component relative to a total number of active hydrogen groups (hydroxyl groups+amino groups) in an active hydrogen-containing compound is preferably in the range of from 0.80 to 1.20 and more preferably in the range of from 0.99 to 1.15. When the number of isocyanate groups is outside the aforementioned range, there is a tendency that curing deficiency is caused, required specific gravity and hardness are not obtained, and polishing property is deteriorated.

The isocyanate-terminated prepolymer is preferably a prepolymer having a molecular weight of about 800 to 1000 because of its excellent workability, physical properties etc. When the prepolymer is solid at an ordinary temperature, the prepolymer is melted by preheating at a suitable temperature prior to use.

A polyurethane resin can be produced by applying a melting method, a solution method or a known polymerization technique, among which preferable is a melting method, consideration being given to a cost, a working environment and the like. Manufacture of a polyurethane resin is enabled by means of either a prepolymer method or a one shot method.

The thermosetting polyurethane foam as the material for forming the polishing layer is produced by a mechanical foaming method (including a mechanical frothing method).

Particularly, a mechanical foaming method using a silicone-based surfactant which is a copolymer of polyalkylsiloxane and polyether is preferable. As such the silicone-based surfactant, SH-192 and L-5340 (manufactured by Toray Dow Corning Silicone Co., Ltd.), B8443 (manufactured by Goldschmidt Ltd.) etc. are exemplified as a suitable compound.

Various additives may be mixed; such as a stabilizer including an antioxidant, a lubricant, a pigment, a filler, an antistatic agent and others.

Description will be given of an example of a method of producing a polyurethane foam (a foam layer) constituting a polishing layer below. A method of manufacturing such a polyurethane foam has the following steps.

(1) The first component wherein a silicon-based surfactant is added to an isocyanate-terminated prepolymer produced by an isocyanate component with a high-molecular-weight polyol or the like is mechanically stirred in the presence of an unreactive gas, to disperse the unreactive gas as fine cells thereby forming a cell dispersion. Then, the second component containing active hydrogen-containing compounds such as low-molecular-weight polyols and low-molecular-weight polyamines are added to, and mixed with, the cell dispersion to prepare a cell dispersed urethane composition. If necessary, a catalyst and a filler such as carbon black may be added to the second component.

(2) A silicon-based surfactant is added to the first component containing an isocyanate component (or an isocyanate-terminated prepolymer) and/or the second component containing active hydrogen-containing compounds, and the component(s) to which the silicon-based surfactant is added is mechanically stirred in the presence of an unreactive gas, to disperse the unreactive gas as fine cells thereby forming a cell dispersion. Then, the remaining component is added to, and mixed with, the cell dispersion to prepare a cell dispersed urethane composition.

(3) A silicon-based surfactant is added to at least either of the first component containing an isocyanate component (or an isocyanate-terminated prepolymer) or the second component containing active hydrogen-containing compounds, and the first and second components are mechanically stirred in the presence of an unreactive gas, to disperse the unreactive gas as fine cells thereby preparing a cell dispersed urethane composition.

Alternatively, the cell dispersed urethane composition may be prepared by a mechanical frothing method. The mechanical frothing method is a method wherein starting components are introduced into a mixing chamber, while an unreactive gas is mixed therein, and the mixture is mixed under stirring with a mixer such as an Oaks mixer thereby dispersing the unreactive gas in a fine-cell state in the starting mixture. The mechanical frothing method is a preferable method because a density of the polyurethane foam can be easily adjusted by regulating the amount of an unreactive gas mixed therein. In addition, the efficiency of production is high because the polyurethane foam having roughly spherical fine cells can be continuously formed.

The unreactive gas used for forming fine bubbles is preferably not combustible, and is specifically nitrogen, oxygen, a carbon dioxide gas, a rare gas such as helium and argon, and a mixed gas thereof, and the air dried to remove water is most preferable in respect of cost.

As a stirring device for dispersing an unreactive gas in a fine-cell state, any known stirring deices can be used without particular limitation, and specific examples include a homogenizer, a dissolver, a twin-screw planetary mixer, a mechanical froth foaming machine etc. The shape of a stirring blade of the stirring device is not particularly limited, and a whipper-type stirring blade is preferably used to form fine cells. For obtaining the intended polyurethane foam, the number of revolutions of the stirring blade is preferably 500 to 2000 rpm, more preferably 800 to 1500 rpm. The stirring time is suitably regulated depending on the intended density.

In a preferable mode, different stirring devices are used for preparing a cell dispersion in the foaming process and for stirring the first and the second components to mix them, respectively. Stirring in the mixing step may not be stirring for forming cells, and a stirring device not generating large cells is preferably used in the mixing step. Such a stirring device is preferably a planetary mixer. The same stirring device may be used in the foaming step of preparing a cell dispersion and in the mixing step of mixing the respective components, and stirring conditions such as a revolution rate of the stirring blade are preferably regulated according to necessary.

In the first and second inventions, the cell dispersed urethane composition prepared by the method described above is applied onto a base material layer, and the cell dispersed urethane composition is cured to form a polyurethane foam layer (polishing layer) directly on the base material layer.

In the third invention, on one hand, the cell dispersed urethane composition prepared by the method described above is applied onto a release sheet, and a base material layer is laminated on the cell dispersed urethane composition. Thereafter, the cell dispersed urethane composition is cured while its thickness is made uniform with a pressing means to form a polyurethane foam layer (polishing layer).

The base material layer is not particularly limited, and examples include a plastic film such as nylon, polypropylene, polyethylene, polyester and polyvinyl chloride, a nonwoven fabric such as a polyester nonwoven fabric, a nylon nonwoven fabric and an acrylic nonwoven fabric, a nonwoven fabric impregnated with resin, such as a polyester nonwoven fabric impregnated with polyurethane, a polymer resin foam such as polyurethane foam and polyethylene foam, rubber-like resin such as butadiene rubber and isoprene rubber, and photosensitive resin. Among these materials, a plastic film such as nylon, polypropylene, polyethylene, polyester and polyvinyl chloride and a polymer resin foam such as polyurethane foam and polyethylene foam are preferably used. A double-sided tape, or a single-sided pressure-sensitive adhesive tape (a pressure-sensitive adhesive layer on one side is stuck to a platen), may be used as the base material layer.

The base material layer preferably has hardness equal to or higher than that of the polyurethane foam in order to confer toughness on the polishing pad. The thickness of the base material layer (or the thickness of the base material in the case of a double-sided tape and a single-sided pressure-sensitive adhesive tape) is not particularly limited, but is preferably 20 to 1000 μm, more preferably 50 to 800 μm from the viewpoint of strength and flexibility.

A material for forming the release sheet is not particularly limited, and can include the same resin and paper as in the base material layer described above. The release sheet is preferably a sheet of less dimensional change upon heating. The surface of the release sheet may have been subjected to release treatment.

In the fourth invention, the cell dispersed urethane composition prepared by the method described above is applied onto a sheet A having a nitrogen gas permeability rate of $1\times10^{-7}$ [$cm^3/cm^2\cdot s\cdot cmHg$] or less. The nitrogen gas permeability rate of the sheet A is preferably $1\times10^{-8}$ [$cm^3/cm^2\cdot s\cdot cmHg$] or less.

A material for forming the sheet A includes, for example, polyethylene terephthalate, polypropylene and polyethylene. The sheet A may be a double-sided tape having adhesive layers on both sides of a base material sheet comprising the above material.

The thickness of the sheet A (or the thickness of the base material sheet in the case of a double-sided tape) is not particularly limited, but is preferably 0.025 to 0.3 mm, more preferably 0.05 to 0.2 mm from the viewpoint of strength, flexibility, and suppression of the permeability of a gas included in the polyurethane foam layer.

The sheet A may be a release sheet subjected to release treatment. The sheet A may be used as a support layer without release after production of the polyurethane foam layer (polishing layer).

A method of applying the cell dispersed urethane composition onto a base material layer, a release sheet, or sheet A can make use of coating methods using, for example, roll coaters such as a gravure coater, kiss-roll coater and comma coater, die coaters such as a slot coater and fountain coater, and a squeeze coater, a curtain coater etc., and any methods can be used insofar as a uniform coating film can be formed on a base material layer, a release sheet, or sheet A.

Post curing by heating the polyurethane foam formed by applying the cell dispersed urethane composition onto a base material layer, a release sheet or sheet A and then reacting the composition until it does not flow has an effect of improving the physical properties of the polyurethane foam and is thus extremely preferable. Post curing is carried out preferably at 40 to 70° C. for 10 minutes to 24 hours and conducted preferably at normal pressures in order to stabilize the shape of cells.

In the production of the polyurethane foam, known catalysts promoting a polyurethane reaction, such as tertiary amine-based catalysts, may be used. The type and amount of the catalyst added are determined in consideration of flow time for application onto a base material layer after the step of mixing the respective components.

Production of the polyurethane foam may be carried out in a batch system wherein the respective components are weighed, introduced into a container, and mechanically stirred, or in a continuous production system wherein the respective components and an unreactive gas are continuously fed to a stirring device and mechanically stirred, and the resulting cell dispersed urethane composition is sent onto a base material layer to form a product.

In the methods for manufacturing a polishing pad according to the first to third inventions, it is necessary that the thickness of the polyurethane foam is uniformly regulated after or while the polyurethane foam is formed on a base material layer. A method of uniformly regulating the thickness of the polyurethane foam includes, but is not limited to, a method of buffing the polyurethane foam with an abrasive, a method of slicing it with a slicer, a method of pressing it with a pressing plate, etc. In the case of buffing or slicing the polyurethane foam, a polishing layer not having a skin layer on the surface of the polyurethane foam is obtained, or in the case of pressing, a polishing layer having a skin layer on the surface of the polyurethane foam is obtained. Conditions for pressing are not particularly limited, but the temperature is regulated preferably so as not to be lower than the glass transition point.

On the other hand, the cell dispersed urethane composition prepared by the method described above is applied onto a release sheet, and a base material layer is laminated on the cell dispersed urethane composition. Thereafter, the cell dispersed urethane composition may be cured to form a polyurethane foam while the thickness thereof is made uniform with a pressing means. The method is a particularly preferable method because the thickness of the polishing layer can be regulated extremely uniformly.

A pressing means for pressing a sandwich sheet made of the release sheet, the cell disperse durethane composition (cell dispersed urethane layer) and the base material layer to make the thickness of the sandwich sheet uniform is not particularly limited, and for example, a method of pressing it to a predetermined thickness with a coater roll, a nip roll or the like. In considering the fact that, after compression, the size of cells in the foam is increased about 1.2 to 2 times, it is preferable in compression to satisfy the following equation: (Clearance of a coater or nip)−(thickness of the base material layer and release sheet)=(50 to 85% of the thickness of the polyurethane foam after curing). For obtaining a polyurethane foam having a specific gravity of 0.2 to 0.5, the specific gravity of the cell-dispersed urethane composition before passing through a roll is preferably 0.24 to 1.

After the thickness of the sandwich sheet is made uniform, the polyurethane foam is reacted until it does not flow, followed post cure. The conditions for post cure are the same as described above.

Thereafter, the release sheet under the polyurethane foam is released. In this case, a skin layer has been formed on the surface of the polyurethane foam. As described above, when the polyurethane foam is formed by the mechanical foaming method, the fluctuation of cells in the polyurethane foam is lower in the lower-surface side than in the upper-surface side. As described above, the lower-surface side of the polyurethane foam formed is used as a polishing surface, so the fluctuation of cells in the polishing surface is made lower thus further improving the removal rate stability. After the release sheet is released, the polyurethane foam may be buffed or sliced to remove the skin layer.

In the method for manufacturing a polishing pad according to the fourth invention, a sheet A is coated with the cell-dispersed urethane composition, and then a sheet B is laminated on the cell-dispersed urethane composition. Then, the cell-dispersed urethane composition is cured while the thickness thereof is kept uniform with a pressing means to form a polyurethane foam layer.

The sheet B used should have a nitrogen gas permeability rate of $1\times10^{-7}$ [$cm^3/cm^2\cdot s\cdot cmHg$] or less, preferably $1\times10^{-8}$ [$cm^3/cm^2\cdot s\cdot cmHg$] or less. Its forming material satisfying these conditions includes polyethylene terephthalate, polypropylene and polyethylene. The sheet B is preferably a sheet of less dimensional change upon heating. The sheet B may be a double-sided tape having adhesive layers on both sides of a base material sheet comprising the above material. The sheet B may be a release sheet subjected to release treatment. The sheet B may be used as a support layer without release after production of the polyurethane foam layer (polishing layer).

The thickness of the sheet B (or the thickness of the base material sheet in the case of a double-sided tape) is not particularly limited, but is preferably 0.025 to 0.3 mm, more preferably 0.05 to 0.2 mm from the viewpoint of strength, flexibility, and suppression of the permeation of a gas included in the polyurethane foam layer.

A pressing means for pressing a sandwich sheet made of the sheet A, the cell dispersed urethane composition (cell dispersed urethane layer) and the sheet B to make the thickness of the sandwich sheet uniform is not particularly limited, and for example, a method of pressing it to a predetermined thickness with a coater roll, a nip roll or the like. In considering the fact that, after compression, the size of cells in the foam is increased about 1.2 to 2 times, it is preferable in compression to satisfy the following equation: (Clearance of a coater or nip)−(thickness of the sheet A and sheet B)=(50 to 85% of the thickness of the polyurethane foam after curing). For obtaining a polyurethane foam layer having a specific gravity of 0.2 to 0.7, the specific gravity of the cell-dispersed urethane composition before passing through a roll is preferably 0.24 to 1.

After the thickness of the sandwich sheet is made uniform, the polyurethane foam is reacted until it does not flow, followed by post cure by heating to form a polyurethane foam layer. Post curing has an effect of improving the physical characteristics of the polyurethane foam and is thus extremely preferable. Post curing is conducted preferably at 60 to 80° C. for 30 minutes, and conducted preferably at normal pressures to stabilize the shape of cells.

In the fourth invention, it is preferable that the cell-dispersed urethane composition is cured in multiple stages while the thickness thereof is kept uniform with a pressing means. The curing step comprises at least primary curing and secondary curing, and it is preferable that the primary curing is at a curing temperature of 30 to 50° C. for a curing time of 5 to 60 minutes, and the secondary curing is at a curing temperature of 60 to 80° C. for a curing time of 30 minutes or more. After primary curing, the composition is heated as it is and then subjected to secondary curing, or after primary curing, the composition is cooled once to room temperature and then subjected to secondary curing.

Thereafter, the sheet (release sheet) above and/or below the polyurethane foam layer is released. In this case, a skin layer has been formed on the polyurethane foam layer. After the release sheet is released, the polyurethane foam layer may be buffed or sliced to remove the skin layer. When the sheets A and B are used as the support layer, the polyurethane foam layer may be divided into two halves, whereby the polishing sheet having the polyurethane foam layer (polishing layer) on the support layer can be produced in duplicate.

When the polyurethane foam layer is formed by the mechanical foaming method as described above, the fluctuation of cells in the polyurethane foam layer is lower in the lower-surface side than in the upper-surface side. Therefore, when the lower-surface side of the polyurethane foam layer formed is used as a polishing surface, the fluctuation of cells in the polishing surface is lower thereby further improving the removal rate stability.

The thickness of the polyurethane foam is not particularly limited, but is preferably 0.2 to 3 mm, more preferably 0.5 to 2 mm.

The polyurethane foam produced by the method described above has mainly an interconnected cell structure, and the interconnected cell rate thereof is 50% or more, preferably 60% or more.

The polyurethane foam has a roughly spherical interconnected cell with a circular pore formed in the surface of the cell. The interconnected cells are not those formed by clashing.

In the first, second, and fourth inventions, the average cell diameter of interconnected cells in the polyurethane foam is 20 to 300 μm, preferably 50 to 100 μm. The average diameter of circular pores in the surfaces of cells is preferably 100 μm or less, more preferably 50 μm or less. When the average cell diameter deviates from this range, the removal rate is reduced and durability is reduced.

In the third invention, it is preferable that when 3 lines by which the polyurethane foam layer (polishing layer) is divided in the thickness direction into quarters are designated a first line, a second line and a third line in the direction of from the polishing surface to the base material layer, the average value of the average cell diameters in the first to third lines is 35 to 300 μm, more preferably 35 to 100 μm, and particularly preferably 40 to 80 μm. When the average cell diameter deviates from this range, the removal rate and durability tend to be reduced. By virtue of the interconnected cell structure, the polyurethane foam layer has suitable water holding property.

Preferably, the cell diameter distribution (maximum cell diameter/minimum cell diameter) in the first line is the smallest and the cell diameter distribution in the third line is the largest. That is, the distribution of cell diameters in the polyurethane foam layer is preferably increased in the direction of from the polishing surface to the base material layer. The distribution of cell diameters in the first line is preferably 3.5 or less, more preferably 3 or less. The distribution of cell diameters in the second line is usually 4 to 6, and the distribution of cell diameters in the third line is usually 7 or more.

The specific gravity of the polyurethane foam is preferably 0.2 to 0.6, more preferably 0.3 to 0.5. When the specific gravity is less than 0.2, the cell rate becomes so high that durability tends to be deteriorated. When the specific gravity is greater than 0.6, the crosslink density of the material should be lowered to attain a certain modulus of elasticity. In this case, permanent deformation tends to be increased and durability tends to be deteriorated.

The hardness of the polyurethane foam, as determined by an Asker C hardness meter, is preferably 10 to 80 degrees, more preferably 15 to 70 degrees, even more preferably 15 to 35 degrees. When the Asker C hardness is less than 10 degrees, the durability of the polishing layer is reduced, and the planarity of an object of polishing after polishing tends to be deteriorated. When the hardness is greater than 80 degrees, on the other hand, the surface of a material polished is easily scratched.

A shape of the polishing pad of the present invention is not particularly limited, and may be a lengthy form with a length of about 5 to 10 m or a round form with a diameter of about 50 to 150 cm.

A polishing layer is preferably provided with a depression and a protrusion structure for holding and renewing a slurry. Though in a case where the polishing layer is formed with a fine foam, many openings are on a polishing surface thereof which works so as to hold the slurry, a depression and protrusion structure are preferably provided on the surface of the polishing side thereof in order to achieve more of holdability and renewal of the slurry or in order to prevent induction of dechuck error, breakage of a wafer or decrease in polishing efficiency. The shape of the depression and protrusion structure is not particularly limited insofar as slurry can be retained and renewed, and examples include X (stripe) grooves, latticed grooves, concentric circle-shaped grooves, through-holes, non-through-holes, polygonal prism, cylinder, spiral grooves, eccentric grooves, radial grooves, and a combination of these grooves. The groove pitch, groove width, groove thickness etc. are not particularly limited either, and are suitably determined to form grooves. These depression and protrusion structure are generally those having regularity, but the groove pitch, groove width, groove depth etc. can also be changed at each certain region to make retention and renewal of slurry desirable.

The method of forming the depression and protrusion structure is not particularly limited, and for example, formation by mechanical cutting with a jig such as a bite of predetermined size, formation by casting and curing resin in a mold having a specific surface shape, formation by pressing resin with a pressing plate having a specific surface shape, formation by photolithography, formation by a printing means, and formation by a laser light using a $CO_2$ gas laser or the like.

The polishing pads of the first to third inventions may be those having a cushion sheet attached to one side of the base material layer.

The polishing pad of the fourth invention may be that having a cushion sheet attached to one side of the polishing layer or to one side of the support layer.

The cushion sheet (cushion layer) compensates for characteristics of the polishing layer. The cushion layer is required for satisfying both planarity and uniformity which are in a tradeoff relationship in CMP. Planarity refers to flatness of a pattern region upon polishing an object of polishing having fine unevenness generated upon pattern formation, and uniformity refers to the uniformity of the whole of an object of polishing. Planarity is improved by the characteristics of the polishing layer, while uniformity is improved by the characteristics of the cushion layer. The cushion layer used in the polishing pad of the present invention is preferably softer than the polishing layer.

The material forming the cushion layer is not particularly limited, and examples of such material include a nonwoven fabric such as a polyester nonwoven fabric, a nylon nonwoven fabric or an acrylic nonwoven fabric, a nonwoven fabric impregnated with resin such as a polyester nonwoven fabric impregnated with polyurethane, polymer resin foam such as polyurethane foam and polyethylene foam, rubber resin such as butadiene rubber and isoprene rubber, and photosensitive resin.

Means for adhering the cushion layer include: for example, a method in which a double sided tape is sandwiched between the base material layer and the cushion layer, followed by pressing.

A polishing pad of the invention may be provided with a double sided tape on the surface of the pad adhered to a platen.

A semiconductor device is fabricated after operation in a step of polishing a surface of a semiconductor wafer with a polishing pad. The term, a semiconductor wafer, generally means a silicon wafer on which a wiring metal and an oxide layer are stacked. No specific limitation is imposed on a polishing method of a semiconductor wafer or a polishing apparatus, and polishing is performed with a polishing apparatus equipped, as shown in FIG. 1, with a polishing platen 2 supporting a polishing pad 1, a polishing head 5 holding a semiconductor wafer 4, a backing material for applying a uniform pressure against the wafer and a supply mechanism of a polishing agent 3. The polishing pad 1 is mounted on the polishing platen 2 by adhering the pad to the platen with a double sided tape. The polishing platen 2 and the polishing head 5 are disposed so that the polishing pad 1 and the semiconductor wafer 4 supported or held by them oppositely face each other and provided with respective rotary shafts 6 and 7. A pressure mechanism for pressing the semiconductor wafer 4 to the polishing pad 1 is installed on the polishing head 5 side. During polishing, the semiconductor wafer 4 is polished by being pressed against the polishing pad 1 while the polishing platen 2 and the polishing head 5 are rotated and a slurry is fed. No specific limitation is placed on a flow rate of the slurry, a polishing load, a polishing platen rotation number and a wafer rotation number, which are properly adjusted.

Protrusions and scratches on the surface of the semiconductor wafer 4 are thereby removed and polished flatly. Thereafter, a semiconductor device is produced therefrom through dicing, bonding, packaging etc. The semiconductor device is used in an arithmetic processor, a memory etc. Lenses, or glass substrates for hard disks, can also be subjected to final polishing in the same manner as described above.

EXAMPLES

Description will be given of the invention with examples, while the invention is not limited to description in the examples.

[Measurement and Evaluation Methods]

(Measurement of Nitrogen Gas Permeability Rate)

The nitrogen gas permeability rate [$cm^3/cm^2 \cdot s \cdot cmHg$] of the sheet was measured according to ASTM-D-1434. Specifically, the permeability rate was measured in the following manner. The sheet was cut in a size of 12 cmϕ to prepare a sample. The sample was held between 2 plates having a 10 cmϕ gas permeation area, and different pressures were given to both sides of the sample, and the nitrogen gas permeability rate of the sheet was calculated from the slope of a change in the volume of a nitrogen gas permeated with time at 25° C. However, when the sample is a resin, the difference in pressure was 0.5 MPa, and when the sample is a paper, the difference in pressure was 0.3 MPa.

(Measurement of Average Cell Diameter)

The prepared polyurethane foam was sliced with a microtome cutter into measurement samples each with the thinnest possible thickness of 1 mm or less. A surface of a sample was photographed with a scanning electron microscope (S-3500N, Hitachi Science Systems Co., Ltd.) at a magnification of ×200. An effective circular diameter of each of all cells in an arbitrary area was measured with an image analyzing soft (manufactured by MITANI Corp. with a trade name WIN-ROOF) and an average cell diameter was calculated from the measured values. In the case of an oval sphere-shaped cell, its cell diameter was expressed as the diameter of a circular cell equivalent in area to the oval sphere-shaped cell.

(Measurement of the Average Cell Diameter in the Third Invention)

A section of the prepared polyurethane foam layer was observed at 45-fold magnification with SEM (S-3500N, Hitachi Science Systems Co., Ltd.). Three lines by which the polyurethane foam layer had been divided in the thickness direction into quarters were drawn on the obtained image. The length of the line, which in an arbitrary 2 mm line segment thereof, had intersected a cell was measured and the average value was measured. The average value was determined for each of the 3 lines, and the 3 average values thus obtained were further averaged to give the average cell diameter.

(Measurement of Cell Diameter Distribution)

The 3 lines by which the polyurethane foam layer formed had been divided in the thickness direction into quarters were designated a first line, a second line and a third line in the direction of from the polishing surface to the base material layer. The maximum cell diameter and minimum cell diameter in each line were measured and the cell diameter distribution in each line was calculated according to the following equation:

Cell diameter distribution=maximum cell diameter/minimum cell diameter (Measurement of Interconnected Cell Rate)

The interconnected cell rate was measured according to the method ASTM-2856-94-C. 10 polyurethane foams cut out in a circular form were piled and used as a measurement sample. As a measuring instrument, an air comparison specific gravity meter 930 (manufactured by Beckman) was used. The interconnected cell rate was calculated according to the following formula:

Interconnected cell rate (%)=$[(V-V1)/VJ\times 100$

V: apparent volume ($cm^3$) calculated from sample dimension.

V1: sample volume ($cm^3$) measured using the air comparison specific gravity meter.

(Measurement of Specific Gravity)

Determined according to JIS Z8807-1976. The prepared polyurethane foam cut out in the form of a strip of 4 cm×8.5 cm (thickness: arbitrary) was used as a sample for measurement of specific gravity and left for 16 hours in an environment of a temperature of 23±2° C. and a humidity of 50%±5%. Measurement was conducted by using a specific gravity hydrometer (manufactured by Sartorius Co., Ltd).

(Measurement of Hardness)

A hardness was measured in accordance with JIS K-7312. The prepared polyurethane foam was cut into samples with a size of 5 cm×5 cm (with arbitrary thickness), and the samples were left for 16 hours in an environment at a temperature of 23° C.±2° C. and humidity of 50%±5%. When measured, the samples were piled up to a thickness of 10 mm or more. A hardness meter (Asker C hardness meter, pressurized surface height 3 mm, manufactured by Kobunshi Keiki Co., Ltd.) was contacted with a pressurized surface, and 30 seconds later, the hardness was measured.

(Measurement of Adhesive Strength)

The prepared polishing pad was cut out in a size of 25 mm in width and 130 mm in length, and the polyurethane foam layer was released from the base material layer except for the edge of 50 mm in length. Thereafter, the polyurethane foam layer was released from the base material layer at a peel angle of 180° and at a peel rate of 50 mm/min., during which the maximum stress (N) was measured and expressed as adhesive strength (N)

(Measurement of Dressing Rate)

The surface of the prepared polishing layer was dressed uniformly with a rotating diamond dresser (M Type #100, 20 cmϕ circular, manufactured by Asahi Diamond Co., Ltd.). At this time, the dresser load was 100 $g/cm^2$, the number of revolutions of a polishing platen was 30 rpm, the number of revolutions of the dresser was 15 rpm, and the dressing time was 30 minutes. From the thickness of the polishing layer before and after dressing, the dressing rate was calculated.

(Evaluation of Removal Rate Stability)

As a polishing device, SPP600S (manufactured by Okamoto Machine Tool Works, Ltd.) was used to evaluate the removal rate stability of the prepared polishing pad. The evaluation results are shown in Table 1. The polishing conditions are as follows:

Glass plate: 6 inches ϕ, thickness 1.1 mm (optical glass, BK7)
Slurry: Ceria slurry (Showa Denko GPL C1010)
Slurry amount: 100 ml/min
Polishing pressure: 10 kPa
Number of revolutions of polishing platen: 55 rpm
Number of revolutions of glass plate: 50 rpm
Polishing time: 10 min/plate
Number of glass plates polished: 500

First, the removal rate (Å/min) for each of polished glass plates is calculated. The calculation method is as follows:

Removal rate=[amount of change [g] of glass plate before and after polishing/(glass plate density [$g/cm^3$]×polished area [$cm^2$] of glass plate×polishing time [min])]×$10^8$ A removal rate stability (%) is calculated by determining the maximum removal rate, minimum removal rate and average removal rate of from a first glass plate to a final treated glass plate (100 plates, 300 plates or 500 plates in total) and then substituting the above values in the following equation. A lower removal rate stability (%) is indicative of less change in removal rate even when a large number of glass plates are polished. In the present invention, the removal rate stability after treatment of 500 plates is preferably within 15%, more preferably within 10%. The average removal rate after treatment of 500 plates is calculated.

Removal rate stability (%)=[(maximum removal rate−minimum removal rate)/average removal rate of all glass plates]×100

[First Invention]

Example 1

80 parts by weight of high-molecular-weight polyol EX-5030 (manufactured by Asahi Glass Co., Ltd.; OHV, 33; number of functional groups, 3), 5 parts by weight of polycaprolactonetriol (Placcel 305 manufactured by Daicel Chemical Industries, Ltd.; OHV, 305; number of functional groups, 3), 5 parts by weight of polycaprolactonediol (Placcel 205 manufactured by Daicel Chemical Industries, Ltd.; OHV, 208; number of functional groups, 2), 10 parts by weight of diethylene glycol (OHV, 1057; number of functional groups, 2), 6 parts by weight of a silicone-based surfactant (SH-192, manufactured by Dow Corning Toray Silicone Co., Ltd.) and 0.30 part by weight of a catalyst (No. 25, manufactured by Kao Corporation) were introduced into a container and mixed to prepare a second component (40° C.). The average hydroxyl value (OHVav) is 157.8 mg KOH/g (theoretical) and the average number of functional groups (fav) is 2.9 (theoretical) Then, the mixture was stirred vigorously for about 4 minutes at a revolution number of 900 rpm by a stirring blade so as to incorporate bubbles into the reaction system. Thereafter, 44.8 parts by weight of carbodiimide-modified MDI (Millionate MTL manufactured by Nippon Polyurethane Industry Co., Ltd.; NCO wt %, 29 wt %; 40° C.) as a first component were added to the second component (NCO/OH=1.1) and stirred for about 1 minute to prepare a cell dispersed urethane composition.

The prepared cell dispersed urethane composition was applied onto a release sheet (polyethylene terephthalate, Toyobo Ester E7002, thickness: 0.05 mm, manufactured by Toyobo Co., Ltd.) previously subjected to release treatment, to form a cell dispersed urethane layer thereon. Then, the cell dispersed urethane layer was covered with a base material layer (polyethylene terephthalate, Toyobo Ester E5001, thickness: 0.188 mm, manufactured by Toyobo Co., Ltd.). The cell dispersed urethane layer was regulated to be 1.6 mm in thickness with a nip roll (clearance 1.5 mm) and then cured at 60° C. for 60 minutes to form a polyurethane foam layer. Thereafter, the release sheet under the polyurethane foam layer was released. Then, the polyurethane foam layer was regulated to be 1.3 mm in thickness by a slicer (manufactured by Fecken) to regulate thickness accuracy. Thereafter, a double-sided tape (double tack tape manufactured by Sekisui Chemical Co., Ltd) was stuck by a laminator to the surface of the base material layer to prepare a polishing pad. When a section of the polyurethane foam layer was observed under a microscope, spherical interconnected cells with circular pores formed in the surface of the cells had mainly been formed.

Example 2

A polishing pad was prepared in the same manner as in Example 1 except that 80 parts by weight of polymer polyol EX-940 (manufactured by Asahi Glass Co., Ltd.; OHV, 28; number of functional groups, 3) wherein polymer particles comprising a styrene-acrylonitrile copolymer had been dispersed were used in place of EX-5030 and the amount of Millionate MTL incorporated was changed from 44.8 parts by weight to 43.7 parts by weight. The average hydroxyl value (OHVav) is 153.8 mg KOH/g (theoretical) and the average number of functional groups (fav) is 2.9 (theoretical). When a section of the polyurethane foam layer was observed under a microscope, spherical interconnected cells with circular pores formed in the surface of the cells had mainly been formed.

Example 3

A polishing pad was prepared in the same manner as in Example 1 except that 55 parts by weight of EX-940 were used in place of EX-5030, the amount of Placcel 305 incorporated was changed from 5 parts by weight to 20 parts by weight, the amount of Placcel 205 incorporated was changed from 5 parts by weight to 20 parts by weight, the amount of diethylene glycol incorporated was changed from 10 parts by weight to 5 parts by weight, the amount of No. 25 incorporated was changed from 0.30 part by weight to 0.23 part by weight, and the amount of Millionate MTL incorporated was changed from 44.8 parts by weight to 48.5 parts by weight. The average hydroxyl value (OHVav) is 170.9 mg KOH/g (theoretical) and the average number of functional groups (fav) is 2.8 (theoretical). When a section of the polyurethane foam layer was observed under a microscope, spherical interconnected cells with circular pores formed in the surface of the cells had mainly been formed.

Example 4

A polishing pad was prepared in the same manner as in Example 1 except that 35 parts by weight of EX-940 were used in place of EX-5030, the amount of Placcel 305 incorporated was changed from 5 parts by weight to 30 parts by weight, the amount of Placcel 205 incorporated was changed from 5 parts by weight to 30 parts by weight, the amount of diethylene glycol incorporated was changed from 10 parts by weight to 5 parts by weight, the amount of No. 25 incorporated was changed from 0.30 part by weight to 0.10 part by weight, and the amount of Millionate MTL incorporated was changed from 44.8 parts by weight to 61.5 parts by weight. The average hydroxyl value (OHVav) is 216.6 mg KOH/g (theoretical) and the average number of functional groups (fav) is 2.7 (theoretical). When a section of the polyurethane foam layer was observed under a microscope, spherical interconnected cells with circular pores formed in the surface of the cells had mainly been formed.

Comparative Example 1

EX-5030 (90 parts by weight), Placcel 305 (8 parts by weight), diethylene glycol (2 parts by weight), SH-192 (6 parts by weight), and 0.30 part by weight of a catalyst (No. 25) were introduced into a container and mixed to prepare a second component (40° C.). The average hydroxyl value (OHVav) is 75.24 mg KOH/g (theoretical) and the average number of functional groups (fav) is 2.98 (theoretical). Then, the mixture was stirred vigorously for about 4 minutes at a revolution number of 900 rpm by a stirring blade so as to incorporate bubbles into the reaction system. Thereafter, a first component Millionate MTL (21 parts by weight, 40° C.) was added to the second component (NCO/OH=1.1) and stirred for about 1 minute to prepare a cell dispersed urethane composition. Thereafter, a polishing pad was prepared in the same manner as in Example 1. When a section of the polyurethane foam layer was observed under a microscope, the cells were composed almost of closed cells.

Comparative Example 2

10 parts by weight of thermoplastic urethane (Rezamine 7285, manufactured by Dainichiseika Colour & Chemicals Mfg. Co., Ltd.) were dissolved in 90 parts by weight of dimethylformamide to prepare an urethane solution. The urethane solution was applied onto a base material layer (Bolance 4211N, Asker C hardness 22 degrees, manufactured by Toyobo Co., Ltd.) previously regulated by buffing to have a thickness of 0.8 mm, to prepare an urethane film thereon. Thereafter, the urethane film-base material layer was dipped in a DMF-water mixture (DMF/water=30/70) for 30 minutes and then dipped in water for 24 hours to replace the dimethylformamide by water, whereby a polyurethane foam layer was formed. Then, the thickness of the polyurethane foam layer was regulated to have a thickness of 1.3 mm by a slicer (manufactured by Fecken) to regulate thickness accuracy. Thereafter, a double-sided tape (double tack tape manufactured by Sekisui Chemical Co., Ltd) was stuck by a laminator to the surface of the base material layer to prepare a polishing pad. When a section of the polyurethane foam was observed under a microscope, cells in the form of thin and long drops had been formed.

TABLE 1

| | Average cell diameter (μm) | Interconnected cell rate (%) | Specific gravity | C hardness (degrees) | Adhesive strength (N) | Average removal rate (Å/min) | Removal rate stability (%) 100 sheets | 300 sheets | 500 sheets |
|---|---|---|---|---|---|---|---|---|---|
| Example 1 | 64 | 51 | 0.41 | 40 | 8.5 | 980 | 8 | 8 | 9 |
| Example 2 | 59 | 68 | 0.42 | 38 | 8.7 | 1130 | 7 | 7 | 8 |
| Example 3 | 53 | 63 | 0.39 | 35 | 9.3 | 1090 | 6 | 6 | 6 |
| Example 4 | 58 | 56 | 0.35 | 40 | 8.3 | 1050 | 7 | 8 | 9 |
| Comparative Example 1 | 60 | 11 | 0.49 | 29 | 4.5 | 800 | 8 | 9 | 10 |
| Comparative Example 2 | — | 60 | 0.26 | 27 | 7.1 | 940 | 8 | 16 | 22 |

As can be seen from Table 1, the polishing pads of the present invention are excellent in removal rate stability and in the adhesiveness between the polishing layer and the base material layer.

[Second Invention]

Example 1

85 parts by weight of polytetramethylene ether glycol (PTMG1000 manufactured by Mitsubishi Chemical Corporation; number of functional groups, 2; hydroxyl value, 110 mg KOH/g), 5 parts by weight of polycaprolactone polyol (Placcel 205 manufactured by Daicel Chemical Industries, Ltd.; number of functional groups, 2; hydroxyl value, 208 mg KOH/g), 5 parts by weight of polycaprolactone polyol (Placcel 305 manufactured by Daicel Chemical Industries, Ltd.; number of functional groups, 3; hydroxyl value, 305 mg KOH/g), 5 parts by weight of trimethylolpropane (number of functional groups, 3; hydroxyl value, 1245 mg KOH/g), 6 parts by weight of a silicone-based surfactant (B8443 Goldschmidt Ltd.) and 0.3 part by weight of a catalyst (No. 25, manufactured by Kao Corporation) were introduced into a container and mixed. Then, the mixture was stirred vigorously for about 4 minutes at a revolution number of 900 rpm by a stirring blade so as to incorporate bubbles into the reaction system. Thereafter, 33 parts by weight of carbodiimide-modified MDI (Millionate MTL, manufactured by Nippon Polyurethane Industry Co., Ltd.) were added thereto and stirred for about 1 minute to prepare a cell dispersed urethane composition.

The prepared cell dispersed urethane composition was applied onto a release sheet comprising a PET sheet (75 μm thickness, manufactured by Toyobo Co., Ltd.) previously subjected to release treatment, to prepare a cell dispersed urethane layer thereon. Then, the cell dispersed urethane layer was covered with a base material layer comprising a PET sheet (188 μm thickness, manufactured by Toyobo Co., Ltd.). The cell dispersed urethane layer was regulated to be 1.5 mm in thickness with a nip roll, then subjected to primary curing at 40° C. for 30 minutes and then to secondary curing at 70° C. for 30 minutes to form a polyurethane foam (foam layer). Thereafter, the release sheet was released. Then, the polyurethane foam was regulated to have a thickness of 1.3 mm by a slicer (manufactured by Fecken) to regulate thickness accuracy. Thereafter, a double-sided tape (double tack tape manufactured by Sekisui Chemical Co., Ltd) was stuck by a laminator to the surface of the base material layer to prepare a polishing pad.

Examples 2 to 6 and Comparative Example 1

Polishing pads were prepared in the same manner as in Example 1 except that the compounding rations shown in Table 1 were used.

Comparative Example 2

10 parts by weight of thermoplastic urethane (Rezamine 7285, manufactured by Dainichiseika Colour & Chemicals Mfg. Co., Ltd.) were dissolved in 90 parts by weight of dimethylformamide to prepare an urethane solution. The urethane solution was applied onto a base material layer (Bolance 4211N, Asker C hardness 22 degrees, manufactured by Toyobo Co., Ltd.) previously regulated by buffing to have a thickness of 0.8 mm, to prepare an urethane film thereon. Thereafter, the urethane film-base material layer was dipped in a DMF-water mixture (DMF/water 30/70) for 30 minutes and then dipped in water for 24 hours to replace the dimethylformamide by water, whereby a polyurethane foam was formed. Then, the polyurethane foam was regulated to have a thickness of 1.3 mm by a slicer (manufactured by Fecken) to regulate thickness accuracy. Thereafter, a double-sided tape (double tack tape manufactured by Sekisui Chemical Co., Ltd) was stuck by a laminator to the surface of the base material layer to prepare a polishing pad.

TABLE 2

| | Hydroxyl value | Number of functional groups | Example 2 | Example 3 | Example 4 | Example 5 | Example 6 | Comparative Example 1 |
|---|---|---|---|---|---|---|---|---|
| PTMG1000 | 110 | 2 | 60 | 35 | 60 | 60 | 60 | 90 |
| Placcel 205 | 208 | 2 | 15 | 25 | 15 | 15 | 15 | 5 |
| Placcel 305 | 305 | 3 | 15 | 25 | 15 | 15 | 15 | 5 |
| Trimethylol propane | 1254 | 3 | 10 | 15 | 0 | 0 | 0 | 0 |
| Glycerin | 1828 | 3 | 0 | 0 | 10 | 0 | 0 | 0 |
| Triethanolamine | 1128 | 3 | 0 | 0 | 0 | 10 | 0 | 0 |
| Diglycerin | 1350 | 4 | 0 | 0 | 0 | 0 | 10 | 0 |
| B8443 | — | — | 6 | 6 | 6 | 6 | 6 | 6 |
| Kao No. 25 | — | — | 0.23 | 0.1 | 0.23 | 0.23 | 0.23 | 0.36 |
| Millionate MTL | — | — | 63 | 93 | 79 | 60 | 66 | 21 |

TABLE 3

| | Average cell diameter (μm) | Interconnected cell rate (%) | Specific gravity | C hardness (degrees) | Adhesive strength (N) | Dressing rate (μm/min) | Average removal rate (Å/min) | Removal rate stability (%) 100 sheets | 300 sheets | 500 sheets |
|---|---|---|---|---|---|---|---|---|---|---|
| Example 1 | 61 | 51 | 0.49 | 43 | 9.7 | 8.5 | 1050 | 8 | 8 | 9 |
| Example 2 | 55 | 65 | 0.45 | 51 | 12.4 | 9.7 | 1170 | 7 | 7 | 8 |
| Example 3 | 57 | 61 | 0.39 | 68 | 13.1 | 10.3 | 1030 | 6 | 6 | 6 |
| Example 4 | 59 | 58 | 0.42 | 48 | 11.7 | 9.5 | 1090 | 7 | 8 | 9 |
| Example 5 | 58 | 56 | 0.40 | 47 | 10.9 | 8.3 | 1020 | 7 | 8 | 9 |
| Example 6 | 60 | 56 | 0.41 | 49 | 10.5 | 7.8 | 1050 | 7 | 8 | 9 |
| Comparative Example 1 | 60 | 45 | 0.60 | 25 | 4.5 | 5.6 | 850 | 8 | 10 | 13 |
| Comparative Example 2 | — | 60 | 0.26 | 27 | 7.1 | 5.2 | 940 | 8 | 16 | 22 |

As can be seen from Table 3, the polishing pads of the present invention are excellent in removal rate stability, in self-dressing, and in the adhesiveness between the polishing layer and the base material layer.

[Third Invention]

Production Example 40 parts by weight of POP36/28 (polymer polyol, hydroxy value 28 mg KOH/g, made by Mitsui Chemicals, Inc.), 40 parts by weight of ED-37A (polyetherpolyol, hydroxy value 38 mgKOH/g, made by Mitsui Chemicals, Inc.), 10 parts by weight of PLC305 (polyester polyol, hydroxy value 305 mg KOH/g, made by Daicel Chemical Industries, Ltd.), 10 parts by weight of diethylene glycol, 5.5 parts by weight of a silicon-based surfactant (SH-192, made by Toray Dow Corning Silicone Co., Ltd.) and 0.25 part by weight of a catalyst (No. 25, made by Kao Corporation) were introduced into a container and sufficiently mixed. Then, the mixture was stirred vigorously for about 4 minutes at a revolution number of 900 rpm by a stirring blade so as to incorporate bubbles into the reaction system. Thereafter, 46.2 parts by weight of Millionate MTL (made by Nippon Polyurethane Industry Co., Ltd.) were added thereto and stirred for about 1 minute to prepare a cell dispersed urethane composition A.

Example 1

The prepared cell dispersed urethane composition A was applied onto a release sheet (polyethylene terephthalate, thickness 0.2 mm) previously subjected to release treatment, to prepare a cell dispersed urethane layer thereon. Then, the cell dispersed urethane layer was covered with a base material layer (polyethylene terephthalate film, thickness 0.2 mm, manufactured by Toyobo Co., Ltd.). The cell dispersed urethane layer was regulated to be 1.2 mm in thickness with a nip roll and then cured at 70° C. for 3 hours to form a polyurethane foam layer. Thereafter, the release sheet in the lower-surface side of the polyurethane foam layer was released. Then, the surface of the polyurethane foam layer was buffed to a thickness of 1.0 mm by a buffing machine (manufactured by Amitec) to regulate thickness accuracy. Thereafter, a double-sided tape (double tack tape manufactured by Sekisui Chemical Co., Ltd) was stuck by a laminator to the surface of the base material layer to prepare a polishing pad. A photomicrograph of a section of the polishing pad is shown in FIG. 2.

Comparative Example 1

The prepared cell dispersed urethane composition A was applied onto a base material layer (polyethylene terephthalate film, thickness 0.2 mm, Toyobo Co., Ltd.), to prepare a cell dispersed urethane layer thereon. Then, the cell dispersed urethane layer was covered with a release sheet (polyethylene terephthalate, thickness 0.2 mm) previously subjected to release treatment. The cell dispersed urethane layer was regulated to be 1.2 mm in thickness with a nip roll and then cured at 70° C. for 3 hours to form a polyurethane foam layer. Thereafter, the release sheet in the upper-surface side of the polyurethane foam layer was released. Thereafter, a polishing pad was prepared in the same manner as in Example 1. A photomicrograph of a section of the polishing pad is shown in FIG. 3.

TABLE 4

| | Average cell diameter (μm) | Cell diameter distribution First line | Second line | Third line | Specific gravity | C hardness (degrees) | Average removal rate in treatment of 500 plates in total (Å/min) | Removal rate stability (%) 100 plates | 300 plates | 500 plates |
|---|---|---|---|---|---|---|---|---|---|---|
| Example 1 | 67 | 2.8 | 4.0 | 8.3 | 0.42 | 45 | 1090 | 4 | 6 | 7 |
| Comparative Example 1 | 64 | 7.0 | 4.2 | 2.8 | 0.41 | 44 | 1030 | 6 | 9 | 12 |

As can be seen from Table 4, the polishing pads of the present invention are extremely excellent in removal rate stability because of low fluctuation of cells in the vicinity of the polishing surface.

[Fourth Invention]

Example 1

70 parts by weight of high-molecular-weight polyol EX-5030 (manufactured by Asahi Glass Co., Ltd.; OHV, 33; number of functional groups, 3), 30 parts by weight of polycaprolactonetriol (Placcel 305 manufactured by Daicel Chemical Industries, Ltd.; OHV, 305; number of functional groups, 3), 5 parts by weight of a silicone-based surfactant (L-5340, manufactured by Dow Corning Toray Silicone Co., Ltd.) and 0.18 part by weight of a catalyst (No. 25, manufactured by Kao Corporation) were introduced into a container and mixed to prepare a second component (25° C.). The average hydroxyl value (OHVav) is 114.6 mg KOH/g (theoretical) and the average number of functional groups (fav) is 3 (theoretical). Then, the mixture was stirred vigorously for about 4 minutes at a revolution number of 900 rpm by a stirring blade so as to incorporate bubbles into the reaction system. Thereafter, 32.5 parts by weight of carbodiimide-modified MDI (Millionate MTL manufactured by Nippon Polyurethane Industry Co., Ltd.; NCO wt %, 29 wt %; 25° C.) as a first component were added to the second component (NCO/OH=1.1) and stirred for about 1 minute to prepare a cell dispersed urethane composition.

The prepared cell dispersed urethane composition was applied onto a release sheet (polyethylene terephthalate sheet, Toyobo Ester E7002, thickness 0.05 mm, nitrogen gas permeability rate $1.15\times10^{-10}$ [$cm^3/cm^2\cdot s\cdot cmHg$], manufactured by Toyobo Co., Ltd.) previously subjected to release treatment, to prepare a cell dispersed urethane layer thereon. Then, the cell dispersed urethane layer was covered with a support sheet (polyethylene terephthalate, Toyobo Ester E5001, thickness 0.188 mm, nitrogen gas permeability rate $3.72\times10^{11}$ [$cm^3/cm^2\cdot s\cdot cmHg$], manufactured by Toyobo Co., Ltd.). The cell dispersed urethane layer was regulated to be 1.3 mm in thickness with a nip roll (clearance 1.1 mm), then subjected to primary curing at 40° C. for 10 minutes and then to secondary curing at 70° C. for 2 hours to form a polyurethane foam layer. Thereafter, the release sheet under the polyurethane foam layer was released. Then, the surface of the polyurethane foam layer was sliced to a thickness of 1.0 mm by a slicer of handsaw type (manufactured by Fecken) to regulate thickness accuracy. Thereafter, a double-sided tape (double tack tape manufactured by Sekisui Chemical Co., Ltd) was stuck by a laminator to the surface of the support sheet to prepare a polishing pad.

Example 2

A polishing pad was prepared in the same manner as in Example 1 except that primary curing was carried out at 70° C. for 2 hours, and subsequent secondary curing was not carried out.

Example 3

A polishing pad was prepared in the same manner as in Example 1 except that a release sheet (polypropylene, Toyopearl SS P4256, thickness 0.05 mm, nitrogen gas permeability rate $2.33\times10^{-9}$ [$cm^3/cm^2\cdot s\cdot cmHg$], manufactured by Toyobo Co., Ltd.) was used in place of the release sheet described in Example 1.

Comparative Example 1

A polyurethane foam layer was formed in the same manner as in Example 1 except that a release sheet (paper, Separator 70GS, thickness 0.058 mm, nitrogen gas permeability rate $1.06\times10^{-6}$ [$cm^3/cm^2\cdot s\cdot cmHg$], manufactured by Oji Paper Co., Ltd.) and a support sheet (paper, Separator 70GS, thickness 0.058 mm, nitrogen gas permeability rate $1.06\times10^{-6}$ [$cm^3/cm^2\cdot s\cdot cmHg$], manufactured by Oji Paper Co., Ltd.) were used in place of the release sheet and the support sheet described in Example 1. Thereafter, the release sheet and the support sheet above and below the polyurethane foam layer were released. Then, both sides of the polyurethane foam layer were sliced to a thickness of 1.0 mm by a slicer of handsaw type (manufactured by Fecken) to regulate thickness accuracy. Thereafter, a double-sided tape (base material: polyethylene terephthalate) was stuck by a laminator to the polyurethane foam layer to prepare a polishing pad.

TABLE 5

| | Average cell diameter (μm) | Interconnected cell rate (%) | Specific gravity | C hardness (degrees) | Removal rate stability (%) 100 plates | 300 plates | 500 plates |
|---|---|---|---|---|---|---|---|
| Example 1 | 60 | 65 | 0.35 | 34 | 6 | 7 | 9 |
| Example 2 | 75 | 69 | 0.32 | 31 | 6 | 9 | 12 |
| Example 3 | 65 | 64 | 0.36 | 35 | 6 | 8 | 10 |
| Comparative Example 1 | 62 | 58 | 0.43 | 40 | 7 | 14 | 20 |

As can be seen from Table 5, the polishing pads of the present invention are excellent in removal rate stability. In Comparative Example 1, when the release sheet and support sheet having a high nitrogen gas permeability rate were used, the polyurethane foam layer was shrunk and did not have a spherical cell structure.

The invention claimed is:

1. A polishing pad comprising a polishing layer arranged on a base material layer, wherein the polishing layer comprising a thermosetting polyurethane foam having roughly spherical interconnected cells having an average cell diameter of 20 to 300 μm, the polyurethane foam comprises an isocyanate component and an active hydrogen-containing compound as starting components, and the active hydrogen-containing compound comprises 30 to 85% by weight of a high-molecular-weight polyol having 2 to 4 functional groups and a hydroxyl value of 20 to 100 mg KOH/g.

2. The polishing pad according to claim 1, wherein the high-molecular-weight polyol comprises 20 to 100% by weight of a polymer polyol in which particles of at least one polymer selected from the group consisting of polystyrene, polyacrylonitrile and a styrene-acrylonitrile copolymer are dispersed.

3. The polishing pad according to claim 1, wherein the active hydrogen-containing compound comprises 2 to 15% by weight of a low-molecular-weight polyol having a hydroxyl value of 400 to 1830 mg KOH/g and/or a low-molecular-weight polyamine having an amine value of 400 to 1870 mg KOH/g.

4. The polishing pad according to claim 1, wherein the active hydrogen-containing compound comprises 5 to 60% by weight of a polyester polyol.

5. A polishing pad comprising a polishing layer arranged on a base material layer, wherein the polishing layer comprises a thermosetting polyurethane foam having roughly spherical interconnected cells having an average cell diameter of 20 to 300 μm, the polyurethane foam comprises an isocyanate component and an active hydrogen-containing compound as starting components, and the active hydrogen-containing compound comprises 1 to 20% by weight of a low-molecular-weight polyol having 3 to 8 functional groups and a hydroxyl value of 400 to 1830 mg KOH/g and/or a low-molecular-weight polyamine having 3 to 8 functional groups and an amine value of 400 to 1870 mg KOH/g.

6. The polishing pad according to claim 5, wherein the low-molecular-weight polyol is at least one member selected from the group consisting of trimethylolpropane, glycerin, diglycerin, 1,2,6-hexanetriol, triethanolamine, pentaerythritol, tetramethylol cyclohexane, methylglucoside, and alkylene oxide adducts thereof, and the low-molecular-weight polyamine is at least one member selected from the group consisting of ethylene diamine, tolylene diamine, diphenylmethane diamine, and alkylene oxide adducts thereof.

7. The polishing pad according to claim 5, wherein the active hydrogen-containing compound comprises 30 to 85% by weight of a high-molecular-weight polyol having 2 to 4 functional groups and a hydroxyl value of 20 to 150 mg KOH/g.

8. The polishing pad according to claim 5, wherein the isocyanate component is carbodiimide-modified MDI.

9. A polishing pad comprising:

a base material layer; and a polyurethane foam layer having roughly spherical interconnected cells and disposed on the base material layer, wherein when three planes by which the polyurethane foam layer is divided in the thickness direction into quarters are designated a first plane, a second plane and a third plane in the direction of from a polishing surface of the polyurethane foam layer to the base material layer, a cell diameter distribution, which is defined as a maximum cell diameter/minimum cell diameter ratio, in the first plane is the smallest and the cell diameter distribution in the third plane is the largest.

10. The polishing pad according to claim 9, wherein the cell diameter distribution in the first line is 3.5 or less.

11. The polishing pad according to claim 9, wherein an average value of average cell diameters in the first to third lines is 35 to 300 μm.

12. A method for manufacturing a semiconductor device, which comprises a step of polishing the surface of a semiconductor wafer with the polishing pad of claim 1 or 5.

* * * * *